US009545977B1

(12) United States Patent
Swiatek

(10) Patent No.: US 9,545,977 B1
(45) Date of Patent: Jan. 17, 2017

(54) SURF TAB

(71) Applicant: Ryan Swiatek, Wichita Falls, TX (US)

(72) Inventor: Ryan Swiatek, Wichita Falls, TX (US)

( * ) Notice: Subject to any disclaimer, the term of this patent is extended or adjusted under 35 U.S.C. 154(b) by 0 days.

(21) Appl. No.: 15/165,467

(22) Filed: May 26, 2016

Related U.S. Application Data

(63) Continuation-in-part of application No. 14/757,728, filed on Dec. 22, 2015.

(51) Int. Cl.
*B63B 1/22* (2006.01)
*B63B 35/85* (2006.01)

(52) U.S. Cl.
CPC ..... *B63B 1/22* (2013.01); *B63B 35/85* (2013.01); *B63B 2035/855* (2013.01)

(58) Field of Classification Search
CPC ..... B63B 1/32; B63B 35/85; B63B 1/20; B63B 2035/855; B63B 1/22; B63B 1/286
USPC ..... 114/285, 284
See application file for complete search history.

(56) References Cited

U.S. PATENT DOCUMENTS 3,200,785 A 8/1965 Holger et al.

*Primary Examiner* — Lars A Olson
(74) *Attorney, Agent, or Firm* — Shannon L Warren

(57) ABSTRACT

A wake-shaping system comprising a one or more surf tabs attached to a watercraft. The one or more surf tabs comprise at least a first surf tab. The first surf tab comprises an upper plate, a mounting hinge, a lower portion, a one or more mounting brackets comprising at least a first mounting bracket. A hydro-thruster assembly having a one or more hydro-thruster diversion fins. further, the first surf tab comprises a leading edge, a trailing edge, an interior side, an exterior side, a top side and a bottom side. The upper plate is rotatably attached to a portion of the watercraft with the mounting hinge. The watercraft travels through a water in a direction of travel. The leading edge comprises a forward portion of first surf tab relative to the direction of travel and the trailing edge comprises a rearward portion.

17 Claims, 18 Drawing Sheets

SURF TAB

CROSS-REFERENCE TO RELATED APPLICATIONS

This application claims the benefit of U.S. patent application Ser. No. 14/757,728 filed on Dec. 22, 2015, which in turn claims benefit of U.S. Provisional Application No. 62/095,477, which was filed Dec. 22, 2014. The entire disclosures of which are incorporated herein by reference.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a Improved Surf Tab. Examples of surf tabs can be found at U.S. Pat. No. 8,833,286, U.S. Pat. No. 8,578,873, U.S. Pat. No. 8,534,214, U.S. Pat. No. 8,539,897, U.S. Pat. No. 6,941,884, U.S. Pat. No. 4,577,580, U.S. Pat. No. 3,200,785, U.S. Ser. No. 14/626,249, U.S. Pat. No. 9,174,703, and U.S. Pat. No. 9,067,644. None of the known inventions and patents, taken either singularly or in combination, is seen to describe the instant disclosure as claimed. Accordingly, an Improved Surf Tab would be advantageous.

BRIEF SUMMARY OF THE INVENTION

Very few if any leisure activities are more enjoyable than boating. Recreational boating on a lake, the ocean, a river, a canal or any other waterways can be a very pleasant way to spend leisure time.

One (1) way to enhance the joy of boating even more is to add other activities to boating. From fishing to diving a boat can be used for many purposes. But one particularly enjoyable activity associated with various watercrafts is water skiing or water surfing. However, when performing some surfing maneuvers it can be useful to weigh down the side of the watercraft where the water skier is positioned. The additional weight modifies the boat wake which can protect the water skier as well as enabling them to perform acrobatics using the modified watercraft wake. In fact, the wake of a watercraft becomes a highly useful factor when water skiing.

Because of the usefulness of watercraft wakes various manufacturers have devised wake modifying devices which can be attached to the aft of a watercraft to provide modified wakes. These devices can eliminate the need to shift weight along the sides of the watercraft. While some of those devices are useful there has been seen a need to provide devices that enabling a water skier to ski on either side of the watercraft. Wake modifying devices that do exist tend to be large and bulky, generally do not provide a clean wake, and/or are inefficient in regards to watercraft fuel consumption.

Accordingly, there exists a need for a device that can modify watercraft wakes on both sides of a watercraft so as to provide a clean wake while not being unduly large or bulky and while providing improved fuel efficiency.

Awake-shaping system and a method of use thereof are disclosed.

Said wake shaping system comprising a one or more surf tabs attached to a watercraft. The one or more surf tabs comprise at least a first surf tab. The first surf tab comprises an upper plate, a mounting hinge, a lower portion, a one or more mounting brackets comprising at least a first mounting bracket. A hydro-thruster assembly having a one or more hydro-thruster diversion fins, further, the first surf tab comprises a leading edge, a trailing edge, an interior side, an exterior side, a top side and a bottom side. The upper plate is rotatably attached to a portion of the watercraft with the mounting hinge. The watercraft travels through a water in a direction of travel. The leading edge comprises a forward portion of first surf tab relative to the direction of travel. The trailing edge comprises a rearward portion of first surf tab relative to the direction of travel. The watercraft comprises a centerline dividing a starboard side from a port side of the watercraft. The first surf tab is mounted either on the starboard side and/or the port side of the watercraft. The first surf tab is configured for receiving a portion of the water as a fluid-in, channeling a portion of the water through a portion of the first surf tab, and ejecting a portion of the water out of the hydro-thruster assembly in a direction being rearward and outward of the centerline of the watercraft. The interior edge comprises a portion of the one or more surf tabs closest to the centerline of the watercraft. The exterior edge comprises a portion of the one or more surf tabs furthest to the centerline of the watercraft. each of the one or more hydro-thruster diversion fins comprise an upper portions and a lower portions. The hydro-thruster assembly comprises the one or more hydro-thruster diversion fins situated between a portion of the upper plate and the lower bracket. The hydro-thruster assembly is attached at the trailing edge of the first surf tab.

A method of using a wake-shaping system comprising: procuring a one or more surf tabs comprising at least a first surf tab, mounting a mounting hinge of the first surf tab to a transom of a watercraft, transporting and launching the watercraft on a surface of a water, motioning the watercraft in a direction of travel across the water, receiving a portion of the water into a leading edge of the first surf tab as a fluid-in, channeling a portion of the water through a portion of the first surf tab, and ejecting a portion of the water out of a hydro-thruster assembly of the first surf tab in a direction being rearward and outward of a centerline of the watercraft. Wherein, the first surf tab comprises an upper plate, the mounting hinge, a lower portion, a one or more mounting brackets comprising at least a first mounting bracket, the hydro-thruster assembly having a one or more hydro-thruster diversion fins, the leading edge, a trailing edge, an interior side, an exterior side, a top side and a bottom side. The upper plate is rotatably attached to a portion of the watercraft with the mounting hinge. The watercraft travels through the water in the direction of travel. The leading edge comprises a forward portion of first surf tab relative to the direction of travel. The trailing edge comprises a rearward portion of first surf tab relative to the direction of travel. The watercraft comprises the centerline dividing a starboard side from a port side of the watercraft. The first surf tab is mounted either on the starboard side and/or the port side of the watercraft. The interior edge comprises a portion of the one or more surf tabs closest to the centerline of the watercraft. The exterior edge comprises a portion of the one or more surf tabs furthest to the centerline of the watercraft. each of the one or more hydro-thruster diversion fins comprise an upper portions and a lower portions. The hydro-thruster assembly comprises the one or more hydro-thruster diversion fins situated between a portion of the upper plate and the lower bracket. The hydro-thruster assembly is attached at the trailing edge of the first surf tab.

said second slot 906*b* can be angled a second angle 1004*b;*

Figure 11A:
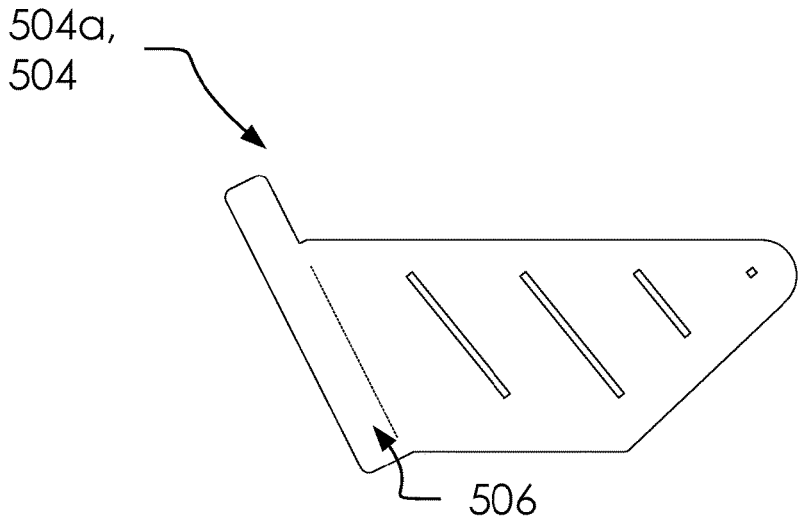
Figure 11B:
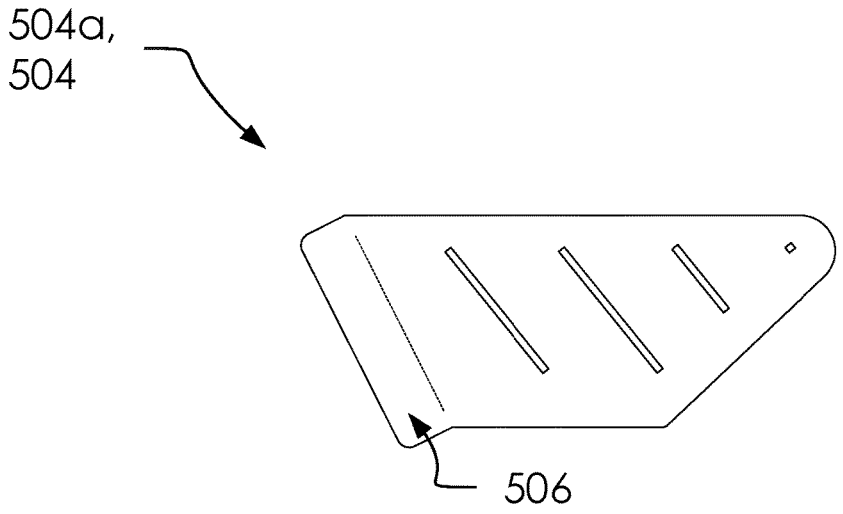
Figure 12A:
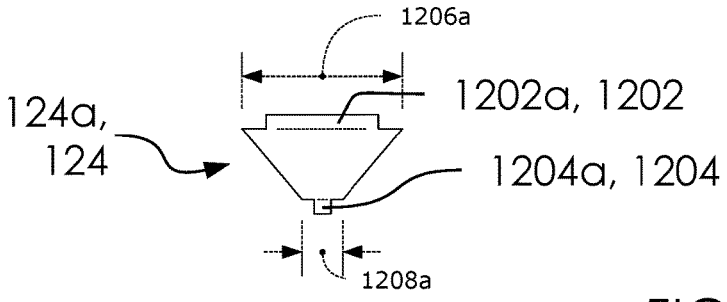
Figure 12B:
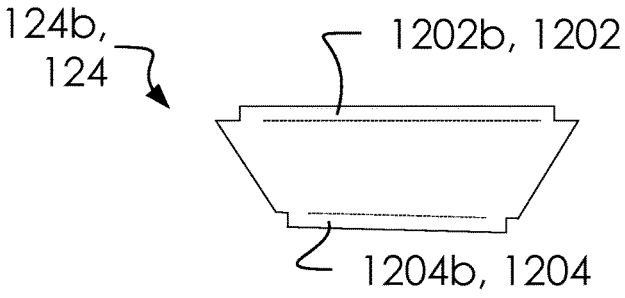
Figure 12C:
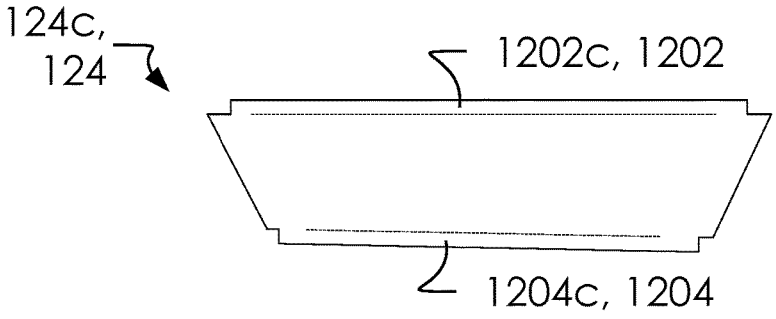
Figure 12D:
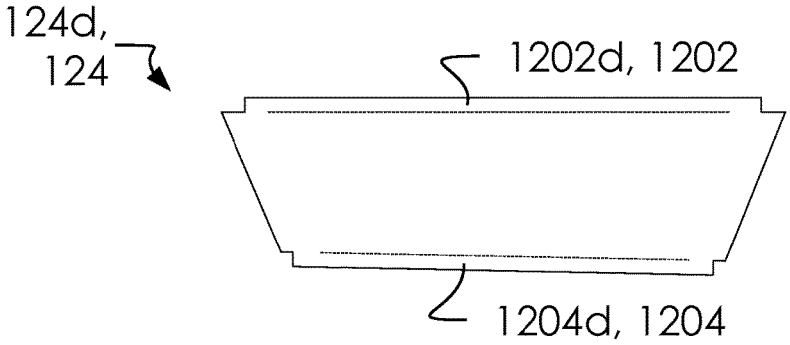

FIGS. 11A and 11B illustrate an elevated top view of said lower bracket 504 as a lower bracket 504*a* and a lower bracket 504*b*.

FIGS. 12A, 12B, 12C and 12D illustrate an elevated side view of said first hydro-thruster diversion fin 124*a*, said second hydro-thruster diversion fin 124*b*, said third hydro-thruster diversion fin 124*c* and said fourth hydro-thruster diversion fin 124*d*.

Figure 13A:
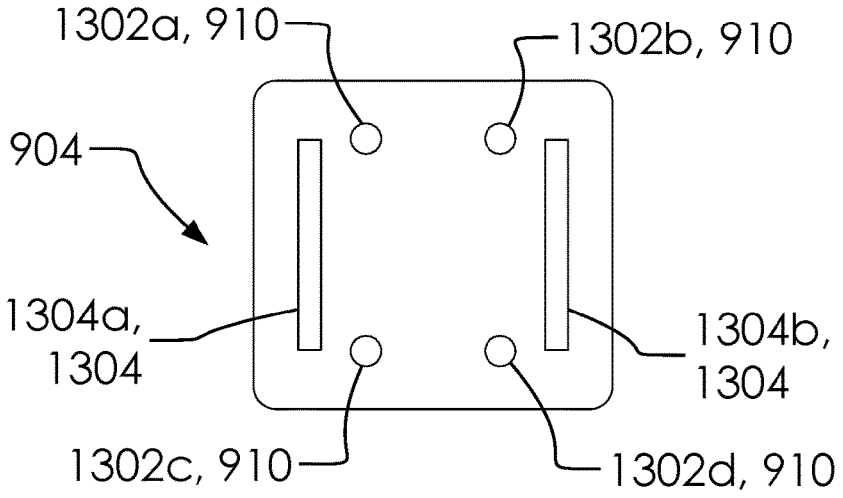
Figure 13B:
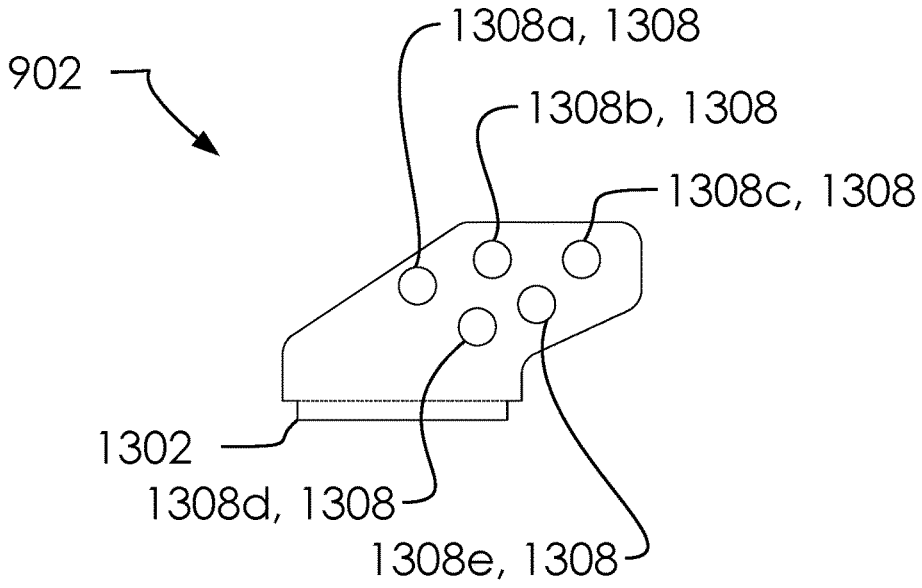

FIGS. 13A and 13B illustrate an elevated top view of said horizontal bracket 904 and an elevated side view of said vertical brackets 902.

Figure 14:
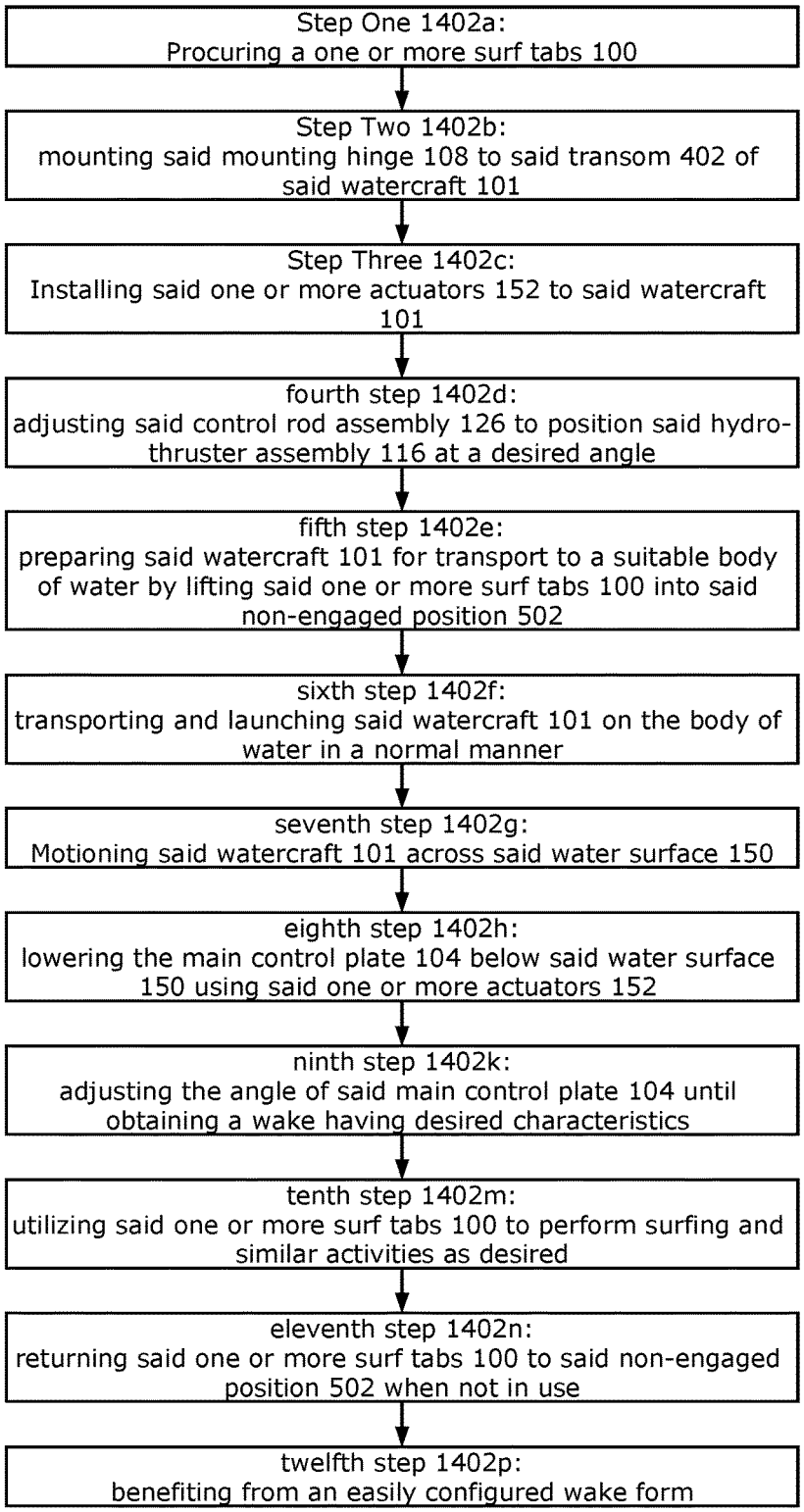

FIG. 14 illustrates a diagram view of a flow chart 1400.

Figure 15:
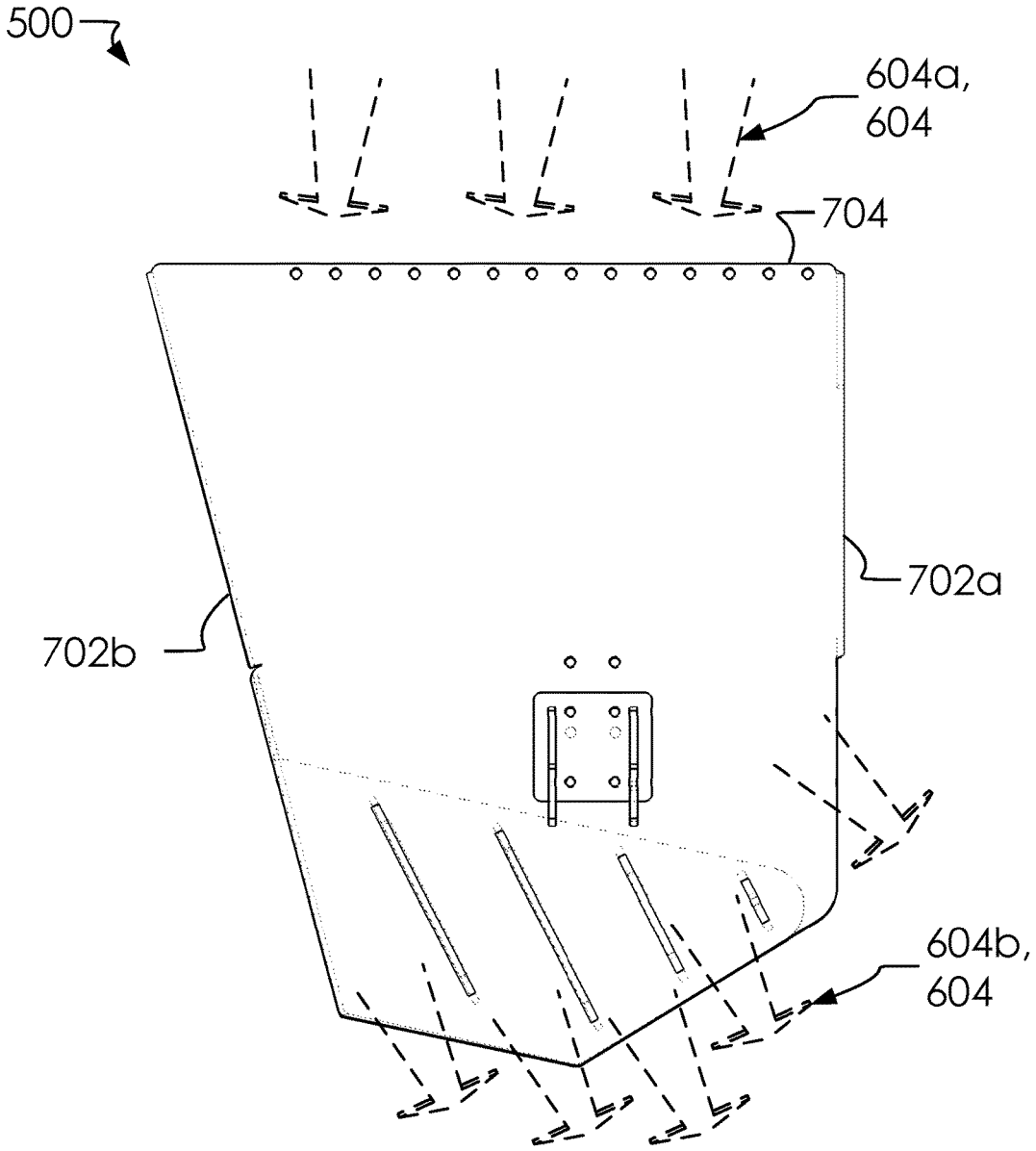

FIG. 15 illustrates an elevated top view of said surf tab 500 with backlines exposed and said fluid 604 superimposed thereupon.

Figure 16A:
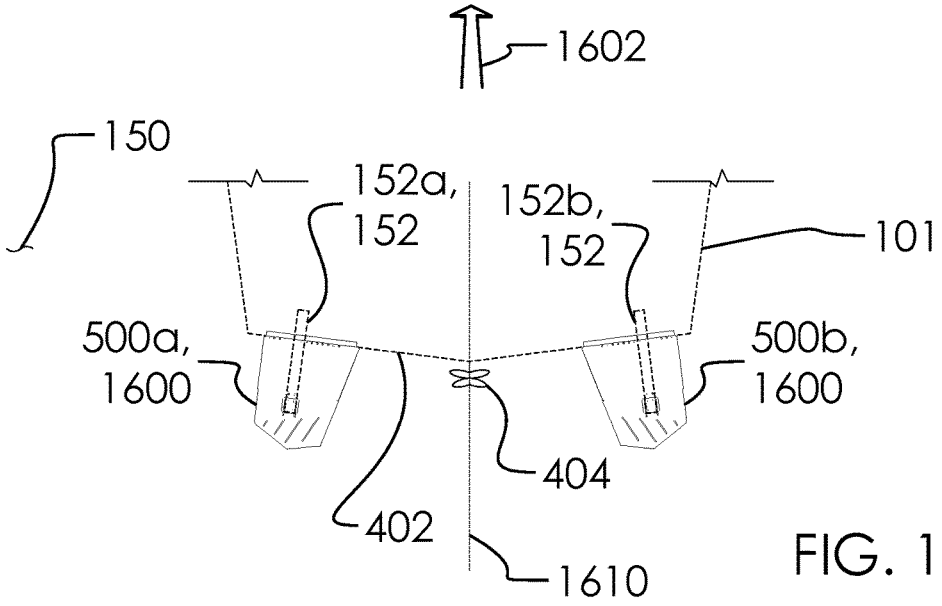
Figure 16B:
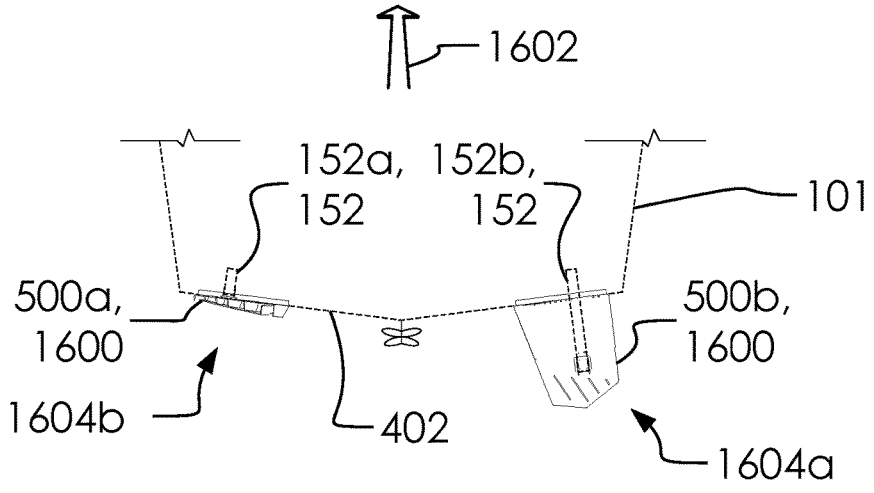

FIGS. 16A and 16B illustrate an elevated top view of a portion of said watercraft 101 with a one or more surf tabs 1600.

Figure 17:
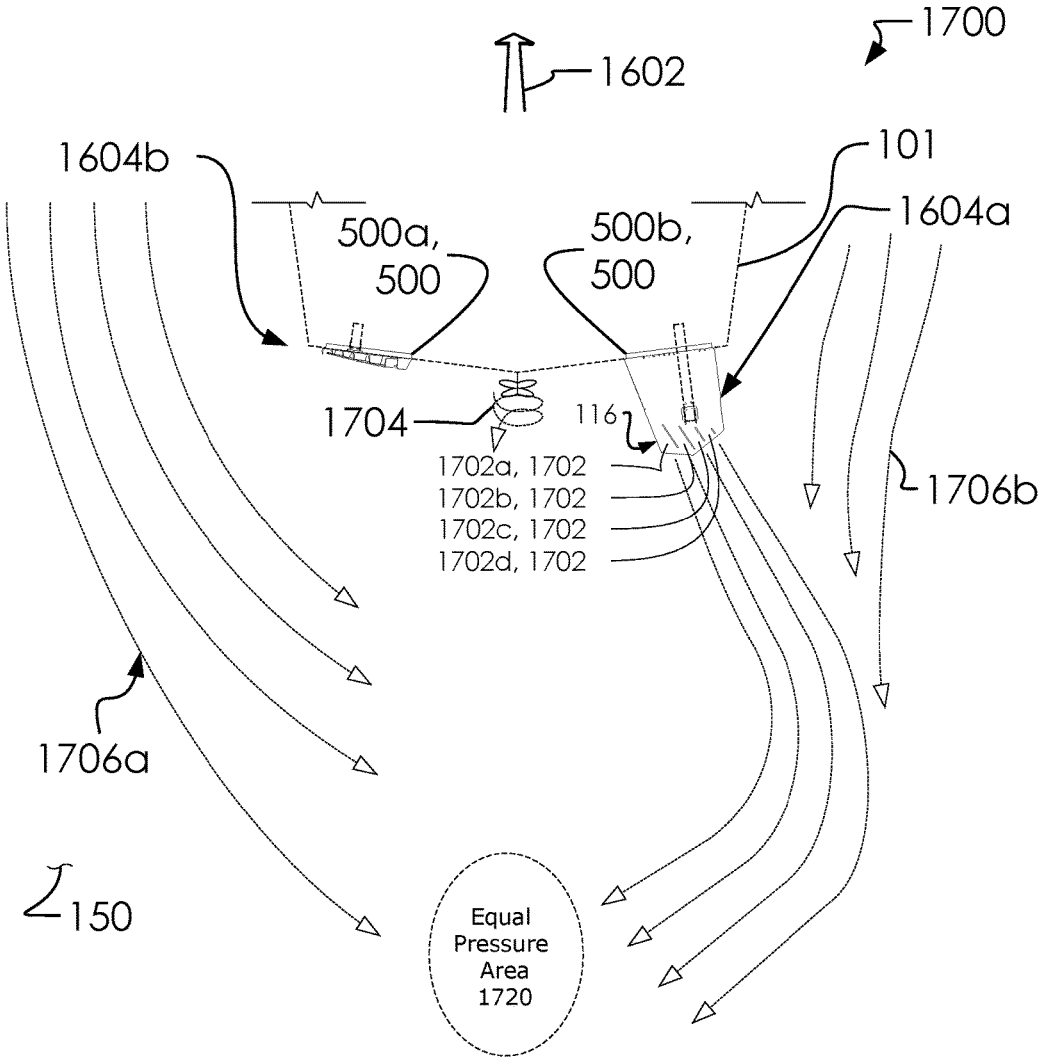

FIG. 17 illustrates a first fluid dynamics analysis 1700 of said surf tab 500 on said watercraft 101.

Figure 18:
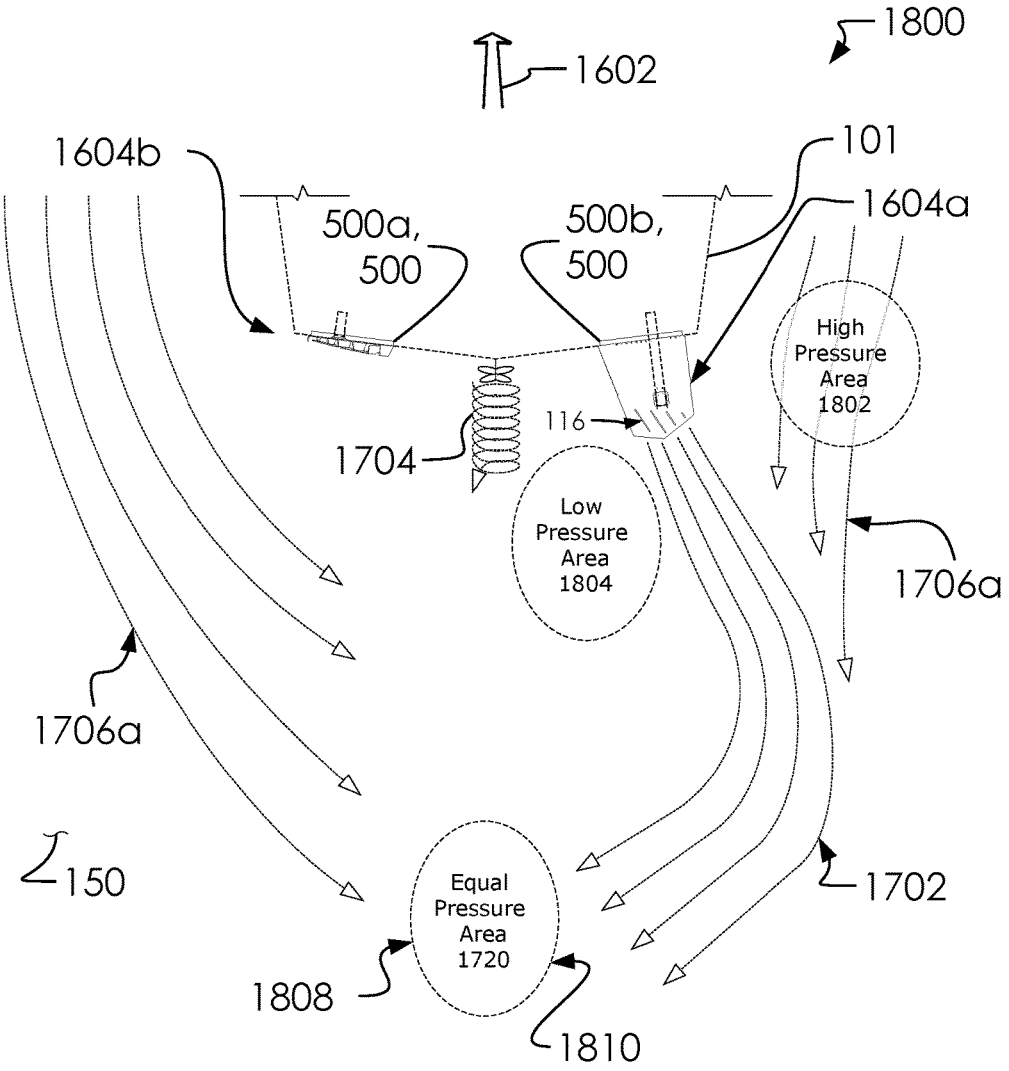

FIG. 18 illustrates a second fluid dynamics analysis 1800.

DETAILED DESCRIPTION OF THE INVENTION

Described herein is an improved surf tab. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
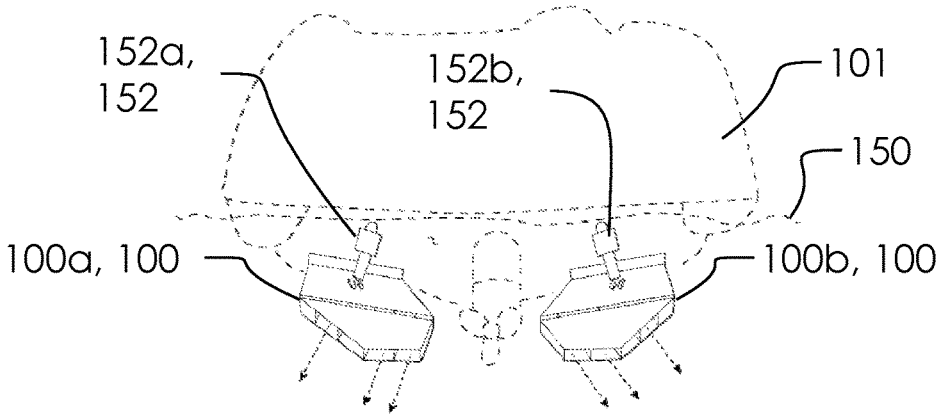
FIG. 1A illustrates elevated rear view of a watercraft 101 with an one or more surf tabs 100.

FIG. 1A illustrates elevated rear view of a watercraft 101 with an one or more surf tabs 100.

Illustrated herein are an one or more surf tabs 100, a port surf tab 100*a*, a port surf tab 100*b*, a watercraft 101, a control plate assembly 102, a main control plate 104, an one or more separation fins 106, a first separation fin 106*a*, a second separation fin 106*b*, a mounting hinge 108, a first portion 108*a*, a second portion 108*b*, a separation hinge 110, a hydro-thruster assembly 116, an central portion 118, a central portion 120, a side hydro-thruster plate 122, an one or more diversion fins 124, a first diversion fin 124*a*, a second diversion fin 124*b*, a third diversion fin 124*c*, a fourth diversion fin 124*d*, a control rod assembly 126, a first end 126*a*, a second end 126*b*, a control rod 126*c*, an one or more mounting brackets 128, a first mounting bracket 128*a*, a second mounting bracket 128*b*, an mounting bracket 130, a water 150, an one or more actuators 152, a first actuator 152*a*, a second actuator 152*b*. In one embodiment, said control rod 126*c* can comprise a variable length, which can be created with an adjustable turnbuckle-style rod.

In one embodiment, said one or more surf tabs 100 can comprise said port surf tab 100*a*, said port surf tab 100*b*, said control plate assembly 102, said mounting hinge 108, said separation hinge 110, said hydro-thruster assembly 116, said fasteners 220, said control rod assembly 126, said one or more mounting brackets 128, said mounting bracket 130, and said one or more actuators 152.

The one or more surf tabs 100 and the port surf tab 100*a* are mirror-images of one another. Thus discussing and describing the port surf tab 100*b* suffices as a discussion and description of the port surf tab 100*a*. However, to aid understanding port surf tab 100*a* is discussed in a manner to enhance the understanding of the mirror-image relationships. It should be understood however that the watercraft 101 does not need to be equipped with both a port surf tab 100*b* and a port surf tab 100*a*. While using both can provide highly beneficial wakes, one (1) or the other can also produce useful wakes. Locating a surf tab on one side will produce a modified wake along that side, while having surf tabs on both sides can produce rather dramatic wake effects across the aft of the watercraft 101.

Figure 1B:
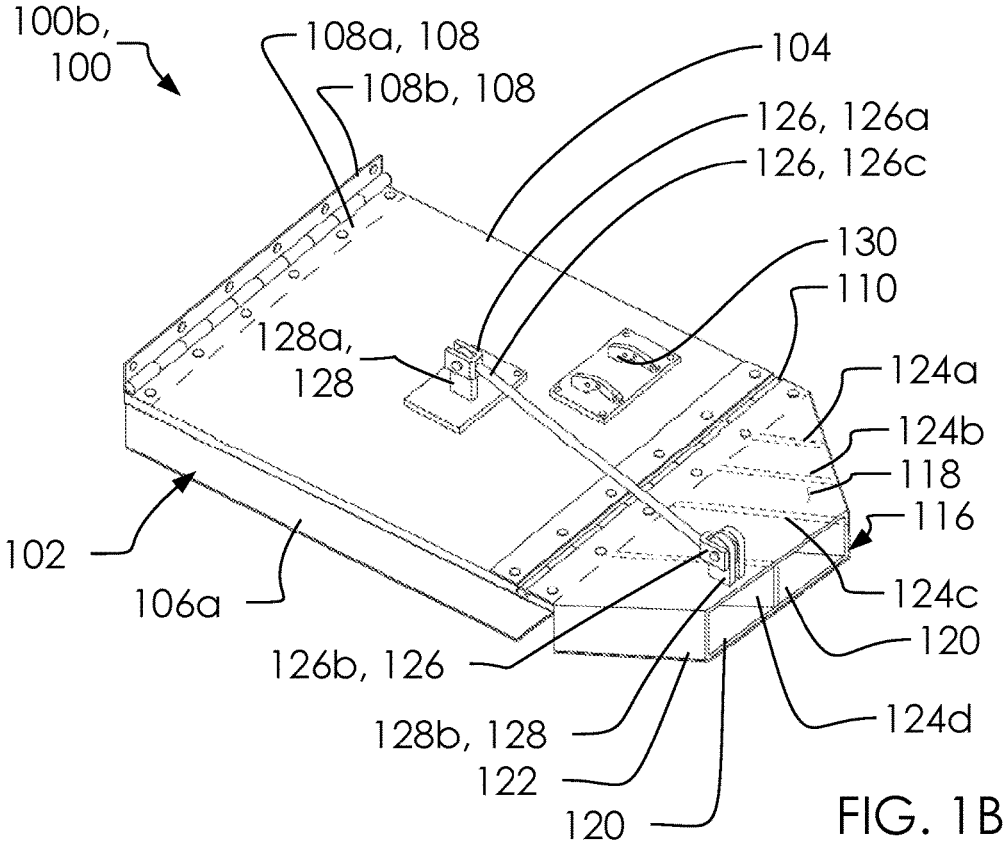
FIG. 1B illustrates perspective overview of a port surf tab 100*b*.

FIG. 1B illustrates perspective overview of a port surf tab 100*b*.

In one embodiment, said one or more surf tabs 100 can shape a wake behind said watercraft 101, as is known in the art. In one embodiment, said port surf tab 100*a* can be attached to a port side of said watercraft 101 and said port surf tab 100*b* can be attached to a port side of said watercraft 101. In one embodiment, said one or more surf tabs 100 can each comprise said control plate assembly 102 and said hydro-thruster assembly 116, which can be adjustably rotated to one another on said mounting hinge 108 and/or said separation hinge 110. In one embodiment, said control plate assembly 102 can be rotatably attached to said watercraft 101 with said mounting hinge 108 and said hydro-thruster assembly 116 can be rotatably attached to said control plate assembly 102 with said separation hinge 110.

In one embodiment, said control rod assembly 126 can comprise an adjustable length which can be set so as to hold said hydro-thruster assembly 116 and a selected angle relative to said control plate assembly 102.

In one embodiment, said one or more mounting brackets 128 can attach said control rod assembly 126 to said control plate assembly 102 and said hydro-thruster assembly 116, as illustrated. For example, in one embodiment, said first mounting bracket 128*a* can attach said first end 126*a* to said control plate assembly 102, and said second mounting bracket 128*b* can attach said second end 126*b* to said hydro-thruster assembly 116.

In one embodiment, said mounting bracket 130 can adjustably receive one among said one or more actuators 152, as illustrated. Thus, an angle between said control plate assembly 102 and said watercraft 101 can be adjusted with said one or more actuators 152 and an angle between said control plate assembly 102 and said hydro-thruster assembly 116 can be adjusted with said control rod assembly 126.

The one or more surf tabs 100 includes the control plate assembly 102 which has a heavy-duty piano-type hinges, said mounting hinge 108, that can be used to attach the one or more surf tabs 100 to the watercraft 101. The control plate assembly 102 also includes a heavy-duty piano-type hinge, said separation hinge 110, which can be located on an end opposite the mounting hinge 108. The separation hinge 110 couples the control plate assembly 102 to the hydro-thruster assembly 116. The control plate assembly 102 and the hydro-thruster assembly 116 are also connected by a control rod assembly 126 disposed between said one or more mounting brackets 128. The first mounting bracket 128*a* can be rigidly attached to the control plate assembly 102, the second mounting bracket 128*b* can be rigidly attached to the hydro-thruster assembly 116, and the control rod assembly 126 can be attached said one or more mounting brackets 128. The control rod assembly 126 can be envisioned as being an adjustable turnbuckle-style device which allows finite angular adjustment of the hydro-thruster assembly 116 to effect wake shape and size.

In one embodiment, said control plate assembly 102 can be beneficially made from welded sections of three-sixteenth (3/16 in.) thick aluminum plate.

As previously noted the hydro-thruster assembly 116 can be attached to the main control plate 104 via the separation hinge 110. The separation hinge 110 can be envisioned as being a piano-type hinge extending across the full width of the main control plate 104 and as allowing the hydro-thruster assembly 116 to pivot.

In one embodiment, said one or more actuators 152 can be operable to be electrically controlled to raise and lower said one or more surf tabs 100 on said mounting hinge 108.

Figure 2:
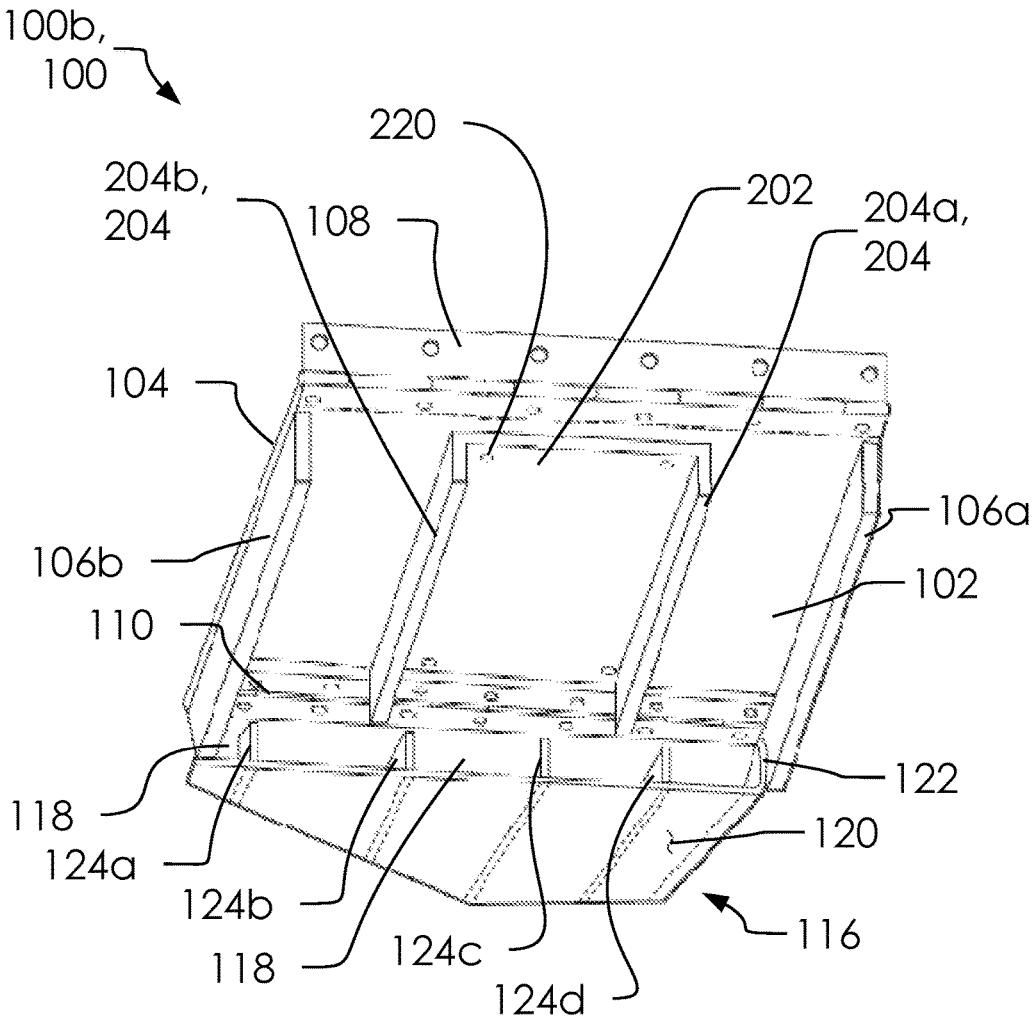
FIG. 2 illustrates perspective lower view of a port surf tab 100*b*.

FIG. 2 illustrates perspective lower view of a port surf tab 100*b*.

Illustrated herein are an intermediate fin plate 202, an one or more setup fins 204, a first setup fin 204*a*, a second setup fin 204*b*, a fasteners 220.

In one embodiment, said intermediate fin plate 202 can comprise said one or more setup fins 204. In one embodiment, said one or more setup fins 204 can comprise said first setup fin 204*a*, said second setup fin 204*b*.

The control plate assembly 102 can comprise said main control plate 104 having sides comprised of said one or more separation fins 106 being downwardly extending fins. In one embodiment, said one or more separation fins 106 can comprise said first separation fin 106*a* and said second separation fin 106*b*.

Additionally, said control plate assembly 102 can comprise said intermediate fin plate 202 comprising a "U"-shaped cross-section. In one embodiment, said intermediate fin plate 202 can be affixed to the lower surface of the main control plate 104 between the first separation fin 106*a* and the second separation fin 106*b* via said fasteners 220. The intermediate fin plate 112 has a first setup fin 204*a* and a parallel fin, said second setup fin 204*b*, which extend perpendicularly downward.

The main control plate 104 does the majority of the work in diverting water to create voids or area of low pressure behind the watercraft 101 as the watercraft travels through the water. The angle of the main control plate 104 relative to the hull of the watercraft 101 as controlled by the one or more actuators 152 controls the overall effect. a downward angle of 100 degrees or so can provide rather dramatic effects. The main control plate 104 provides a large area that can change water flow over a rather long distance and can be adjusted to improve efficiency and reduce drag and cavitation as desired.

In one embodiment, said first separation fin 106*a* is mounted on an inward side of said one or more surf tabs 100 (with reference to a space between said one or more surf tabs 100 as mounted to said watercraft 101). In one embodiment, said first separation fin 106*a* separates water coming off the hull from the water disturbed by the propeller 404. This beneficially results in the water trapped by the main control plate 104 being free of bubbles.

In one embodiment, said second separation fin 106*b* is shorter but also extends along the length of the main control plate 104. In one embodiment, said second separation fin 106*b* lets a small amount of water flow under the main control plate 104 from outside of the watercraft 101. This creates a higher pressure under the one or more surf tabs 100 and thus a lower pressure behind the one or more surf tabs 100 while also providing structural integrity to the main control plate 104.

Said one or more surf tabs 100 as illustrated in FIGS. 1B and 2 comprises said one or more separation fins 106 as covering a full distance between said mounting hinge 108 and said separation hinge 110; however, in another embodiment, said one or more separation fins 106 can be designed and updated according to another specification. Accordingly, FIG. 6 (and following) are included to show a different design for said one or more separation fins 106. More discussion is directed toward this design to come.

In one embodiment, said one or more setup fins 204 can comprise different lengths. For example, in one embodiment, said first setup fin 204*a* is the longer than said second setup fin 204*b*. which run parallel to one (1) another. In one embodiment, said first setup fin 204*a* extends downward and runs the entire length of the main control plate 104. In one embodiment, said second setup fin 204*b* is the shorter of the two (2) setup fins and it also extends downward and runs the entire length of the main control plate 104. Both of said one or more setup fins 204 add to the structural integrity of the one or more surf tabs 100. In one embodiment, said one or more setup fins 204 also help set up the flow of water into an central portion 118 of the hydro-thruster assembly 116.

In one embodiment, said one or more separation fins 106 comprise portions of said main control plate 104 turned downward. In another embodiment, said one or more separation fins 106 can comprise plates welded to said main control plate 104, as is known in the art.

In one embodiment, portions of said one or more surf tabs 100 can comprise welded aluminum.

Figure 3A:
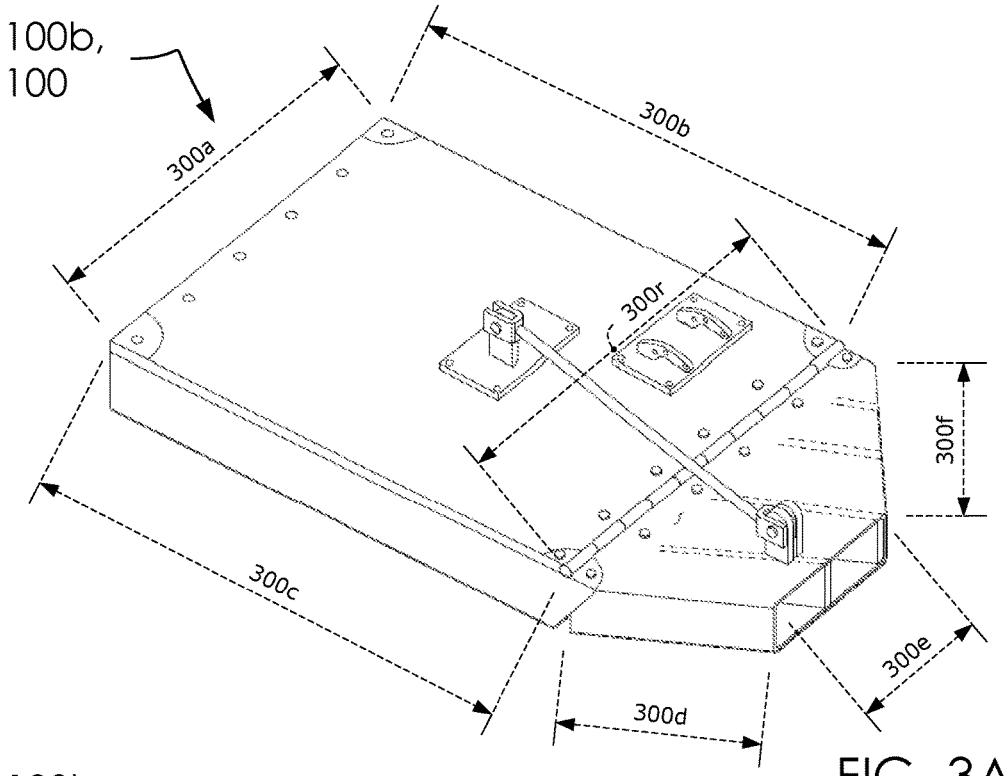
FIGS. 3A and 3B illustrate two perspective overviews of a port surf tab 100*b*.
Figure 3B:
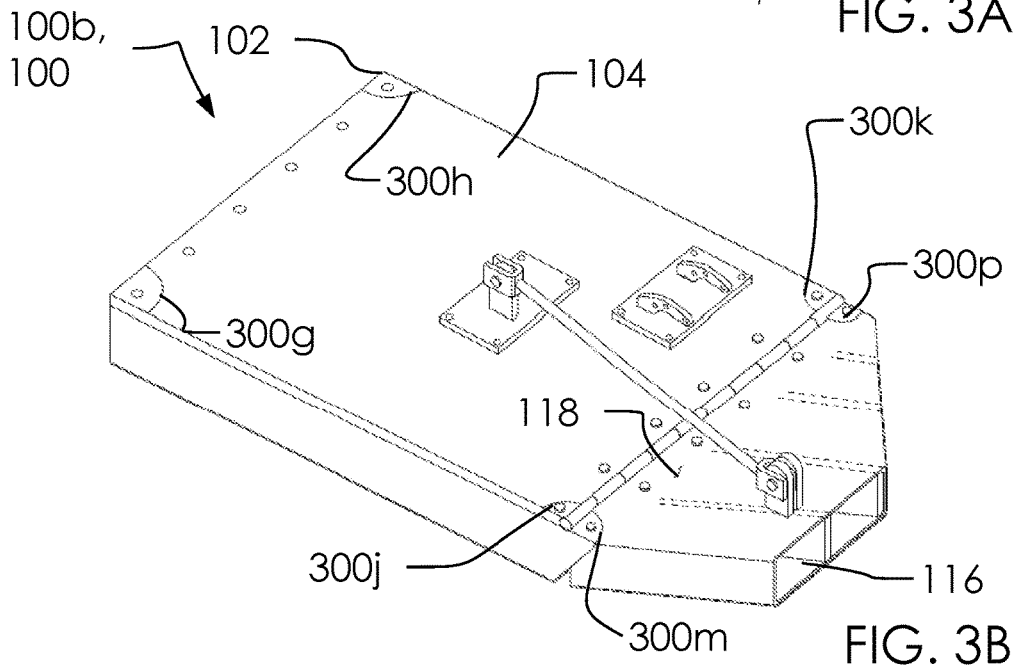

FIGS. 3A and 3B illustrate two perspective overviews of a port surf tab 100*b*.

Illustrated herein are a dimension a 300*a*, a dimension b 300*b*, a dimension c 300*c*, a dimension d 300*d*, a dimension e 300*e*, a dimension f 300*f*, an angle g 300*g*, an angle h 300*h*, an angle j 300*j*, an angle k 300*k*, an angle m 300*m*, an angle n 300*n*, an angle p 300*p*, an angle q 300*q*, a dimension r 300*r*.

In one embodiment, said one or more surf tabs 100 can comprise a variation on dimensions, as would be obvious to one in the art. However, one suggested embodiment comprises said dimension a 300*a* as being 17¾ inches, said angle h 300*h* being 99 degrees, and said angle g 300*g* being 81 degrees. However, variations on these dimensions would result in similar performance and output from said one or more surf tabs 100. In one embodiment, the arrangement of said hydro-thruster assembly 116 behind said watercraft 101 can comprise a primary goal accomplished through a variety of variations on said one or more surf tabs 100. One suggested embodiment can be found in the provisional application to which this applications claims benefit.

Figure 4:
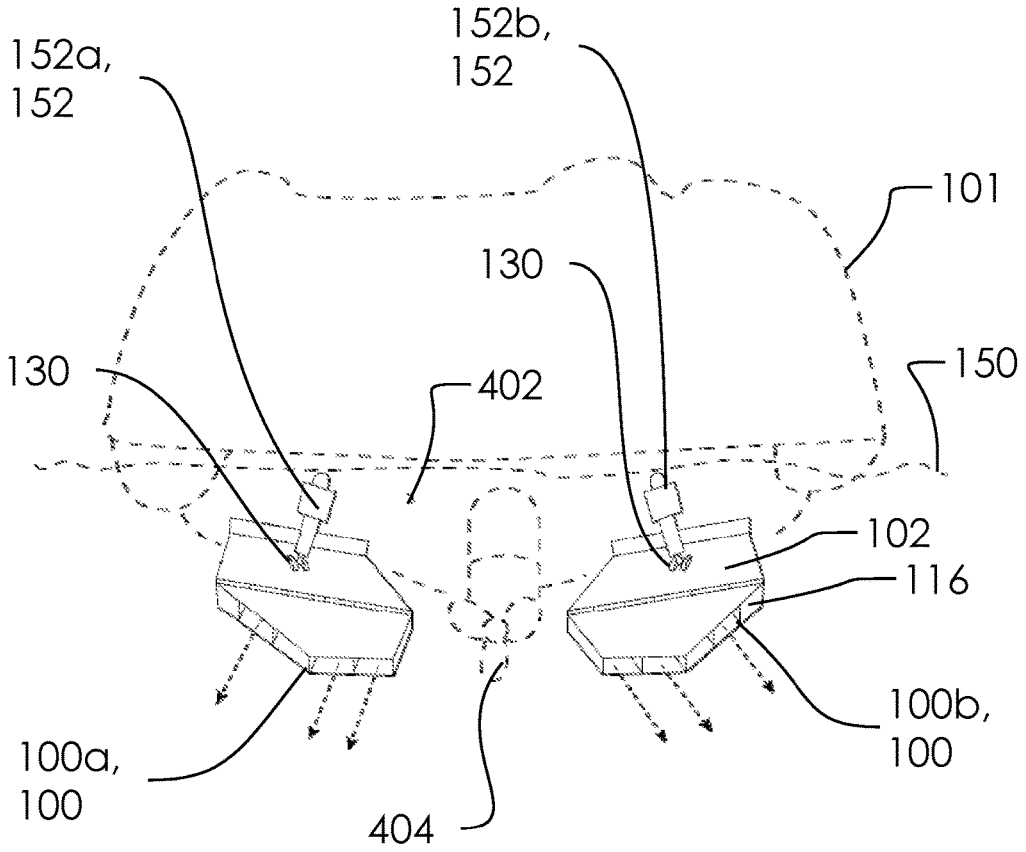
FIG. 4 illustrates elevated rear view of a watercraft 101 with said one or more surf tabs 100.

FIG. 4 illustrates elevated rear view of a watercraft 101 with said one or more surf tabs 100.

Illustrated herein are a transom 402, and a propeller 404.

In one embodiment, said one or more surf tabs 100 can be installed onto said watercraft 101 as illustrated.

The one or more surf tabs 100 and the port surf tab 100*a* are mounted to the transom 402 of the watercraft 101 on respective sides of a propeller 404. In one embodiment, said one or more surf tabs 100 and the port surf tab 100*a* are designed to descend at an user-controlled angle below the water 150 so as to modify the wake created by the watercraft 101 as it moves over said water 150.

In one embodiment, the hydrodynamic effects of the control plate assembly 102 and the hydro-thruster assembly 116 are adjustable by an electric linear embodiment of said one or more actuators 152. In one embodiment, said one or more actuators 152 allows an user to raise and lower the one or more surf tabs 100.

In one embodiment, said one or more actuators 152 is attached at one (1) end to the watercraft 101 and at the other end to mounting brackets 130 which can be rigidly attached to the top of the control plate assembly 102. In one embodiment, said positions of the control rod assembly 126 and the one or more actuators 152 adjust water flow through the one or more surf tabs 100 when the watercraft 460 moves through the water so as to modify the wake created by the watercraft 101. Redirecting the flow of water between the control plate assembly 102 and the hydro-thruster assembly 116 provides lift to the stern of the watercraft 101. Thus, in one embodiment, a fuel savings is anticipated as the one or more surf tabs 100 allows the watercraft 101 to run flat and level across the water 150, allowing the propeller 404 to be more efficient.

The angular positioning of the one or more surf tabs 100 is accomplished via the one or more actuators 152, which is envisioned to be an electric cylinder-type device. In one embodiment, said one or more actuators 152 is envisioned to be similar to those manufactured by LENCO MARINE CO™ and other companies. As such it is envisioned as being controlled using a corresponding control module that is conveniently located so that an operator of the watercraft 101 can make adjustments.

The main control plate 104 does the majority of the work as far as diverting water by creating a void or area of low pressure behind it as the watercraft 101 travels forward. In one embodiment, said angle of the main control plate 104 relative to the hull of the watercraft 101 is important as it also diverts water outward at approximately ten degrees (10°) from the center of the watercraft 101. In one embodiment, said main control plate 104 provides a large area to change the flow of water over a longer distance, thereby improving efficiency, thereby reducing drag and cavitation.

As previously noted the one or more surf tabs 100 may include both port and port control plate assemblies and hydro-thruster assemblies. Those assemblies can work together to produce dynamic hydrodynamic effects. 454.

Figure 5A:
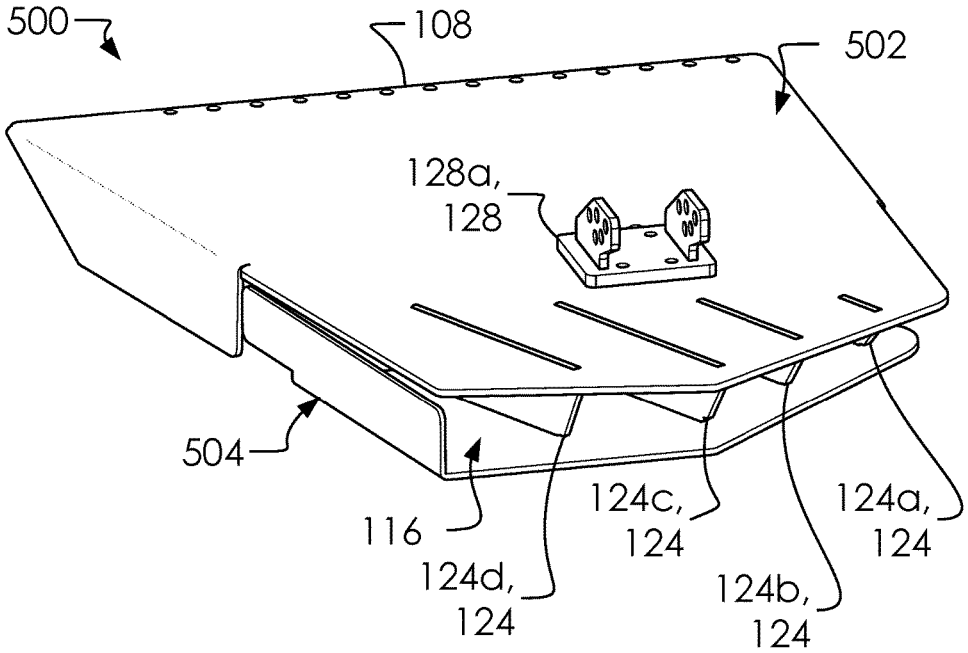
FIGS. 5A and 5B illustrate a perspective overview and lower view of a surf tab 500.
Figure 5B:
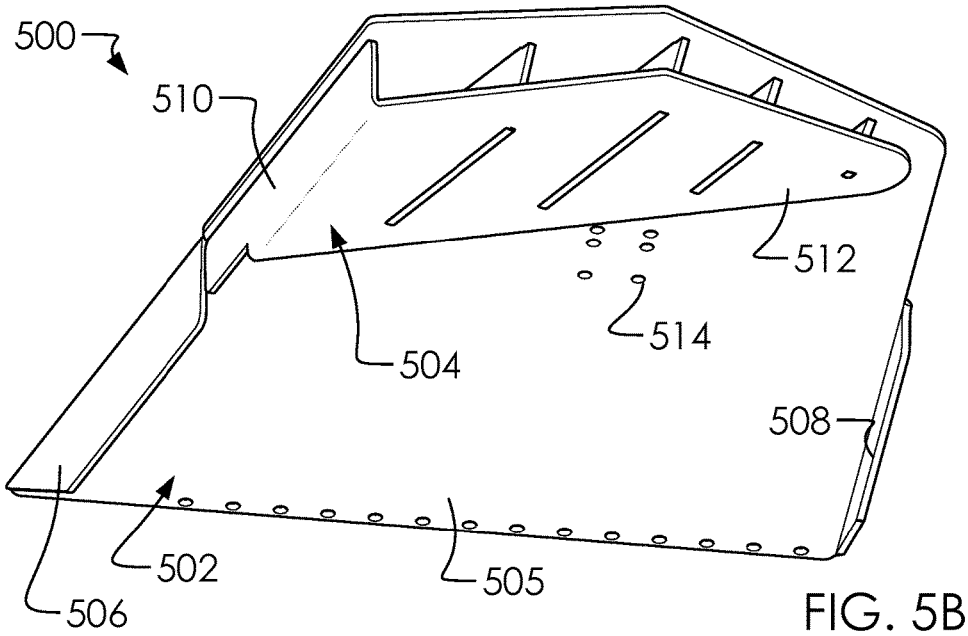

FIGS. 5A and 5B illustrate a perspective overview and lower view of a surf tab 500.

Said surf tab 500 can be the preferred embodiment as defined and required by the USPTO.

Said surf tab 500 can comprise a variation on said one or more surf tabs 100. In one embodiment, said surf tab 500 can comprise a mounting hinge 108, a first mounting bracket 128*a*, a hydro-thruster assembly 116 (having said one or more hydro-thruster diversion fins 124) and said lower bracket 504. In one embodiment, said hydro-thruster assembly 116 can direct fluid being pushed through said surf tab 500, as discussed above. In one embodiment, said upper plate 502 can comprise central portion 505, an inside tab 506 and an outside tab 508. In one embodiment, said lower bracket 504 can comprise central portion 5 side hydro-thruster plate 122 and an inside tab 510. In one embodiment, said central portion 505 can comprise a plurality of apertures 514 designed to receive and attach to a portion of said first mounting bracket 128*a*, as illustrated.

In one embodiment, said central portion 512 and said central portion 505 can be substantially facing one another with said one or more hydro-thruster diversion fins 124 separating said upper plate 502 from said lower bracket 504. In one embodiment, said inside tab 510 and said inside tab 506 can be substantially coplanar. In one embodiment, said inside tab 510 can be located in a trailing portion of said surf tab 500 with respect to fluid being directed through said surf tab 500, and said inside tab 506 and said outside tab 508 can be in a leading portion of said surf tab 500.

Figure 6A:
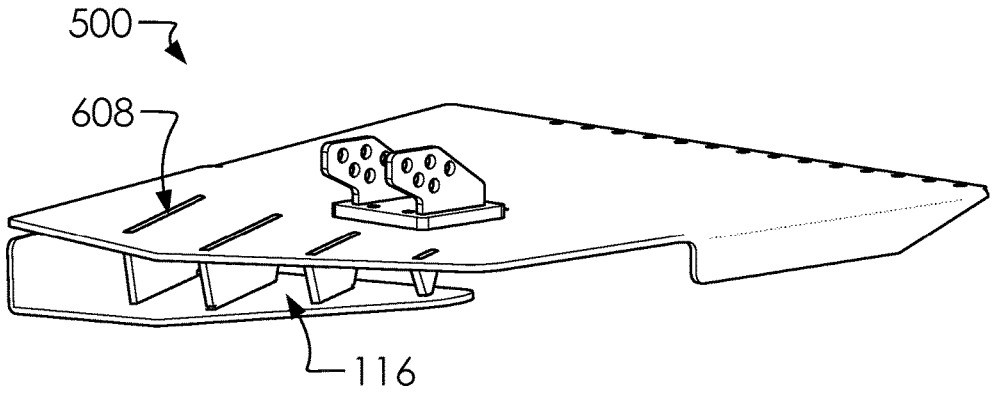
FIGS. 6A and 6B illustrate a perspective overview and lower view of a surf tab 500.
Figure 6B:
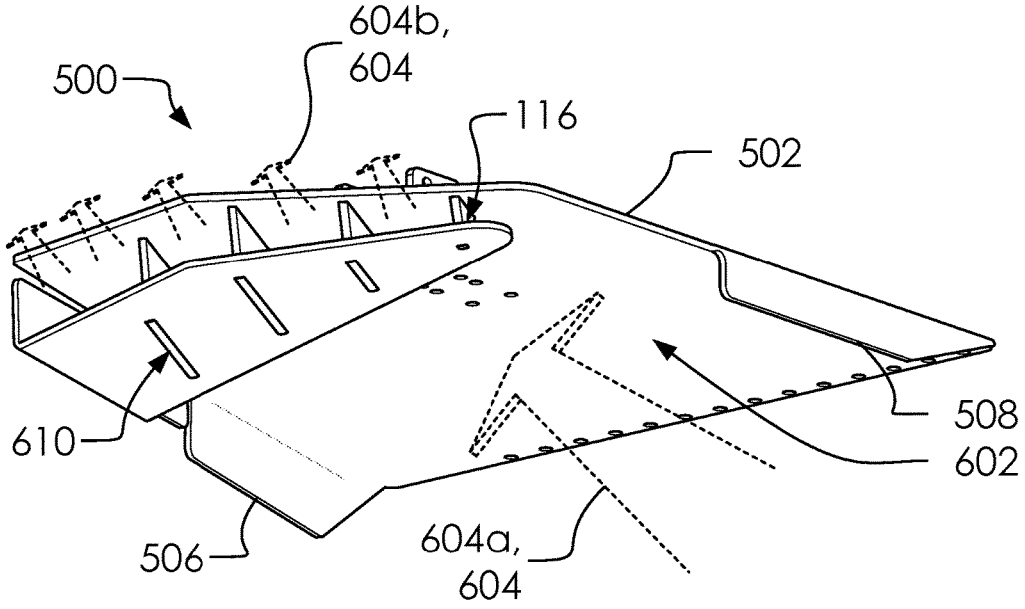

FIGS. 6A and 6B illustrate a perspective overview and lower view of a surf tab 500.

In one embodiment, said surf tab 500 can receive and propel fluid 604 (such as water). For example, in one embodiment, a fluid-in 604*a* can be received at a fluid entry point 602 being below said central portion 505 and between said inside tab 506 and said outside tab 508. In one embodiment, a portion of said fluid 604 is then channeled into said hydro-thruster assembly 116 and ejected as a fluid-out 604*b*, as illustrated.

In one embodiment, said one or more hydro-thruster diversion fins 124 are secured between said upper plate 502 and said lower bracket 504 with a welding 608 and a welding 610 on either side of said surf tab 500. This procedure is well-known in the art and can be applied to each of said one or more hydro-thruster diversion fins 124, as illustrated.

Figure 7A:
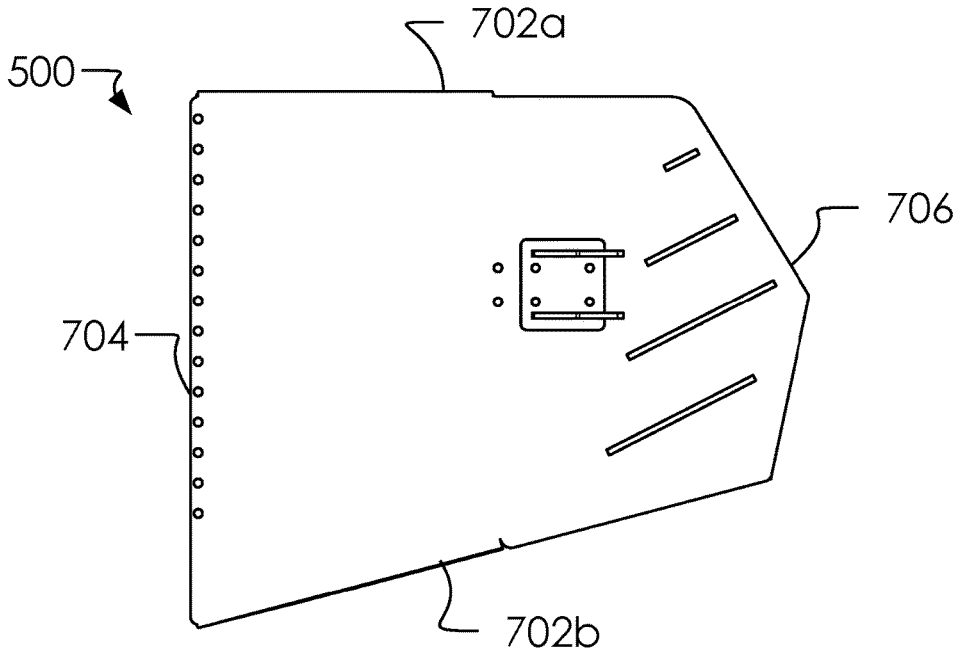
FIGS. 7A and 7B illustrate an elevated top and lower view.
Figure 7B:
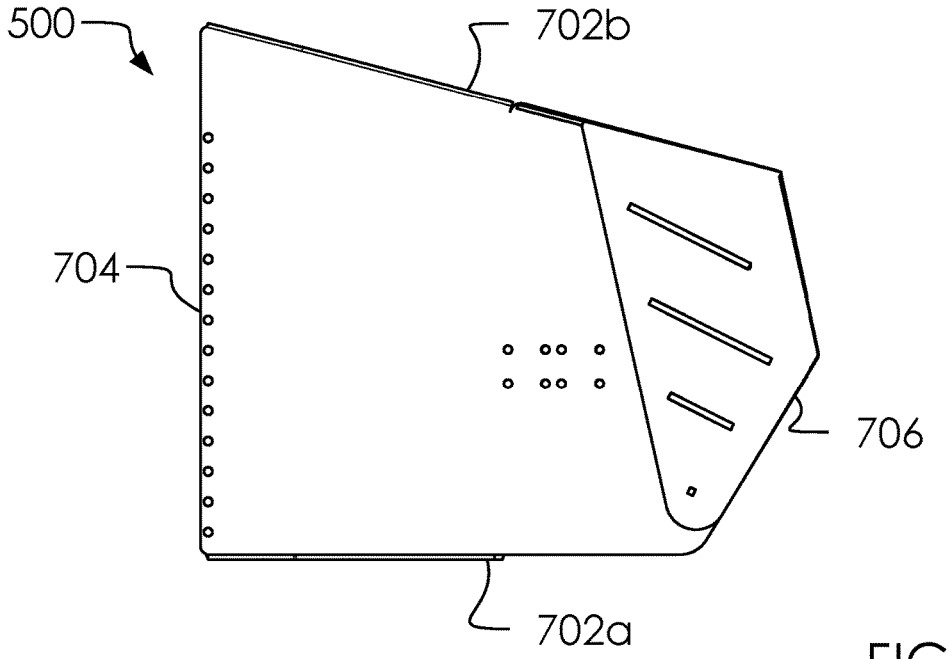
Figure 8A:
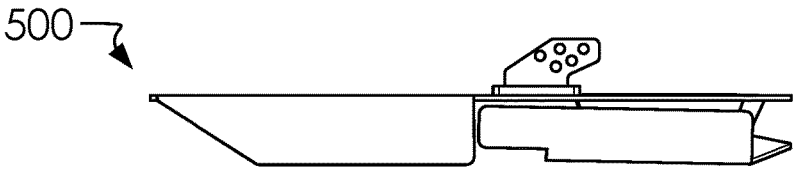
FIGS. 8A, 8B, 8C and 8D illustrate an elevated first side, second side, front side and back side view of said surf tab 500.
Figure 8B:
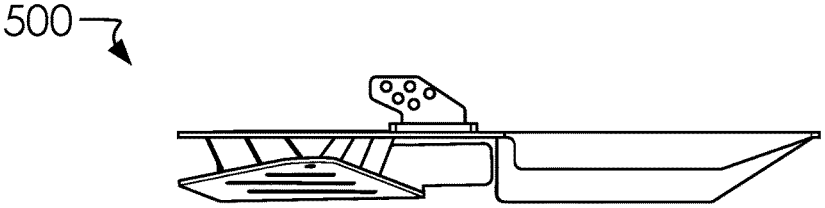
Figure 8C:
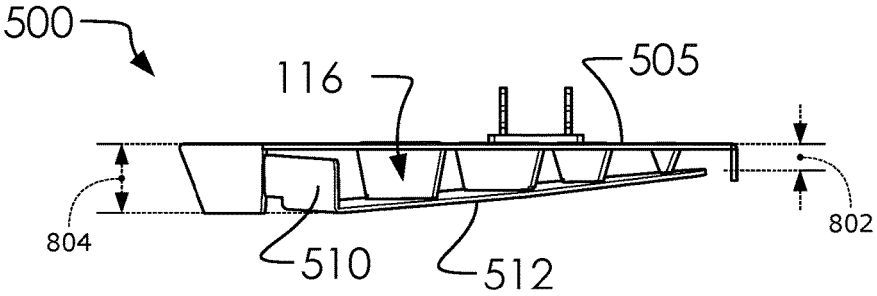
Figure 8D:
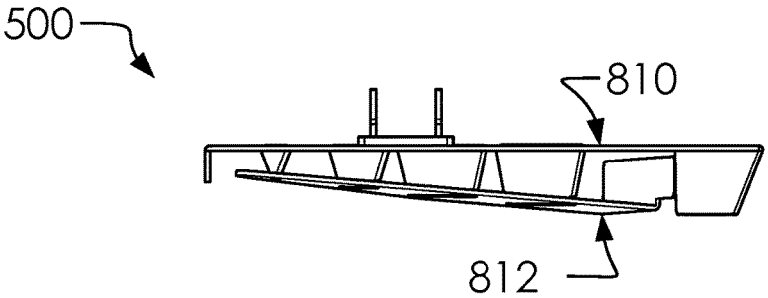

FIGS. 7A and 7B illustrate an elevated top and lower view.

In one embodiment, said surf tab 500 can comprise an exterior edge 702*a*, an interior edge 702*b*, a leading end 704 and a trailing end 706. In one embodiment, said leading end 704 can be considered "leading" in the context of said fluid 604 which enters into said surf tab 500 proximate to said leading end 704. Likewise, said trailing end 706 is "trailing" in the context of said fluid-out 604*b* being ejected proximate to said trailing end 706.

In one embodiment, both of said exterior edge 702*a* and said interior edge 702*b* can comprise a side wall of some kind in the form of said lower bracket 504, said inside tab 506 and said outside tab 508.

FIGS. 8A, 8B, 8C and 8D illustrate an elevated first side, second side, front side and back side view of said surf tab 500.

In one embodiment, said hydro-thruster assembly 116 can comprise a first height 802 and a second height 804. In one embodiment, said first height 802 can be smaller than said second height second height 804. Consequently, when viewed from an elevated rear view, said hydro-thruster assembly 116 can be said to have a wedge shape.

In one embodiment, said surf tab 500 can comprise a top side 810 and a bottom side 812.

Figure 9:
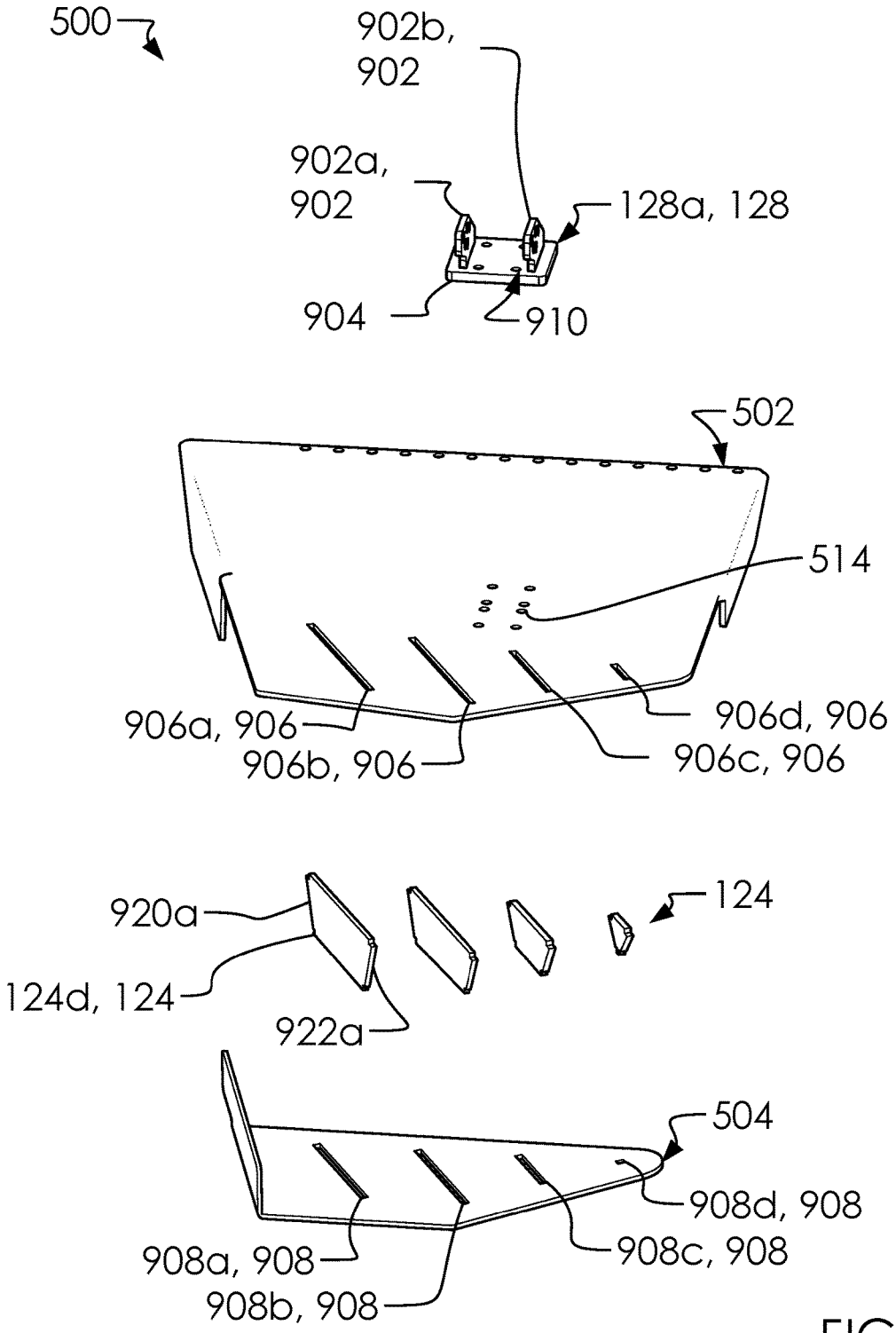
FIG. 9 illustrates an exploded elevated front view of said surf tab 500.

FIG. 9 illustrates an exploded elevated front view of said surf tab 500.

In one embodiment, said first mounting bracket 128*a* can comprise a vertical brackets 902 (which can comprise a first bracket 902*a* and a second bracket 902*b*) and horizontal bracket 904. In one embodiment, said horizontal bracket 904 can comprise a plurality of apertures 910. In one embodiment, said first mounting bracket 128*a* can attach to said upper plate 502 by aligning a portion of said plurality of apertures plurality of apertures 910 with a portion of said plurality of apertures 514, inserting an one or more binding implements (such as a screw, nut and washer assembly), and binding said first mounting bracket 128*a* to said upper plate 502. In one embodiment, said plurality of apertures 514 can have more apertures than said plurality of apertures 910, so as to provide multiple attachment configurations, as is known in the art.

In one embodiment, said upper plate 502 can comprise an upper plate slots 906 (which can comprise a first slot 906*a*, a second slot 906*b*, a third slot 906*c*, and a fourth slot 906*d*). Likewise, in one embodiment, said lower bracket 504 can comprise a lower bracket slots 908 (which can comprise a first slot 908*a*, a second slot 908*b*, a third slot 908*c*, and a fourth slot 908*d*). In one embodiment, a portion said one or more hydro-thruster diversion fins 124 can be inserted into said upper plate slots 906 at an upper portion of said one or more hydro-thruster diversion fins 124 and into said lower bracket slots 908 at a lower portion of said one or more hydro-thruster diversion fins 124. Finally, assembly of said surf tab 500 can comprise welding said one or more hydro-thruster diversion fins 124 to a portion of said upper plate 502 through said upper plate slots 906 and to a portion of said lower bracket 504 through said lower bracket slots 908.

In one embodiment, each among said one or more hydro-thruster diversion fins 124 can comprise a leading edge and a trailing edge. For example, said fourth hydro-thruster diversion fin 124*d* can comprise a leading edge 920*a* and a trailing edge 922*a*. In one embodiment, each among said one or more hydro-thruster diversion fins 124 are arranged with said trailing edge being arranged toward said exterior edge 702*a* so that said one or more hydro-thruster diversion fins 124 direct said fluid-out 604*b* outward, as discussed herein.

Figure 10:
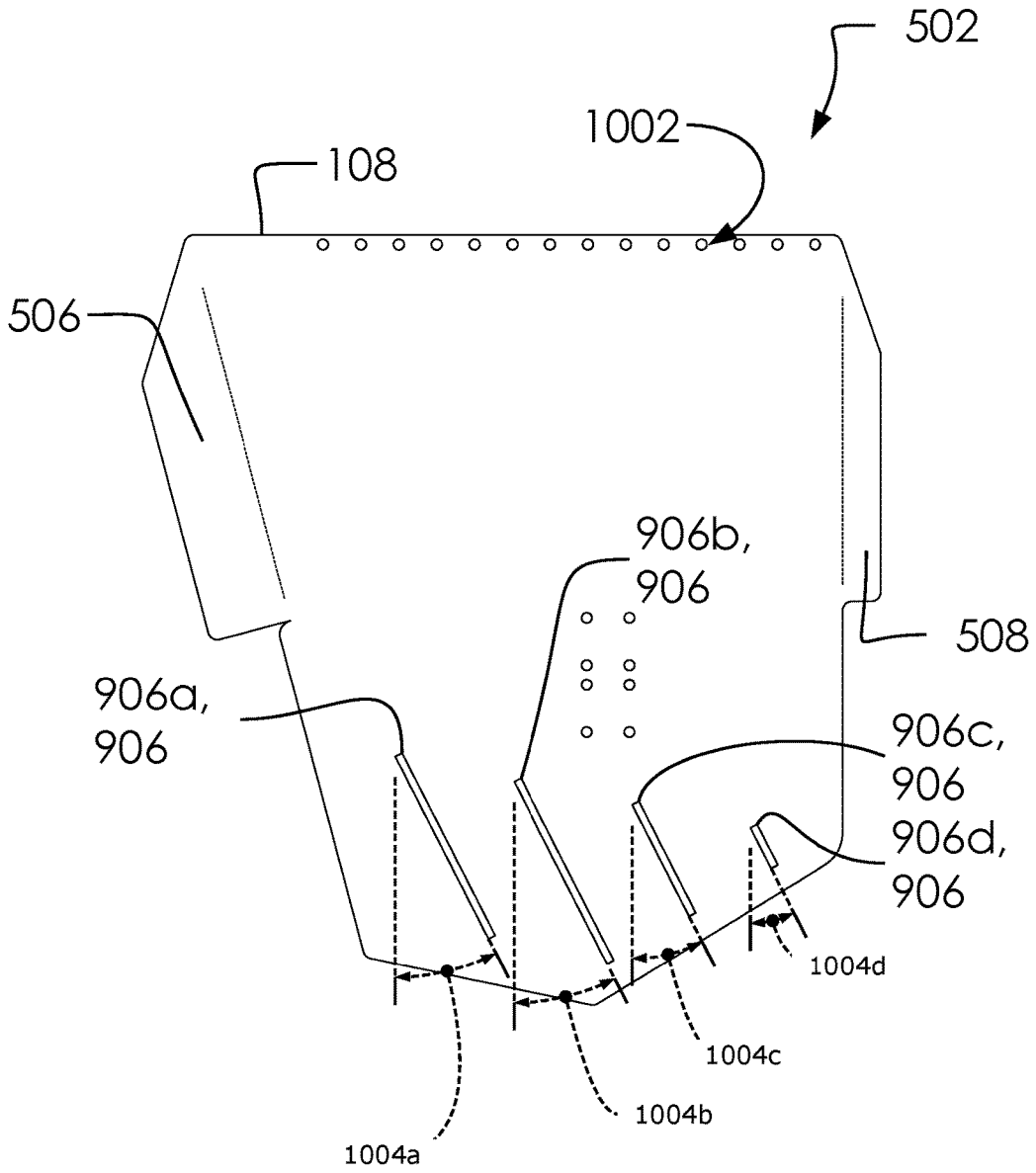
FIG. 10 illustrates an elevated top view of said upper plate 502.

FIG. 10 illustrates an elevated top view of said upper plate 502.

In one embodiment, said upper plate 502 can comprise a flat sheet of metal being cut out of a blank, as is known in the art. In one embodiment, said inside tab 506 and said outside tab 508 can be added by bending a portion of said upper plate 502 down after forming said upper plate 502.

In one embodiment, said upper plate 502 can comprise a plurality of apertures 1002 at said mounting hinge 108; wherein, said plurality of apertures plurality of apertures 1002 can be used to attach said surf tab 500 to a portion of said watercraft 101, as discussed above.

In one embodiment, said upper plate slots 906 can each be angled rearward and outward at a deflection angle so as direct said water 150 outward with said hydro-thruster assembly 116. In one embodiment, said first slot 906*a* can be angled a first angle 1004*a*; said second slot 906*b* can be angled a second angle 1004*b*; said third slot 906*c* can be angled a third angle 1004*c*; and said fourth slot 906*d* can be angled a fourth angle 1004*d*.

FIGS. 11A and 11B illustrate an elevated top view of said lower bracket 504 as a lower bracket 504*a* and a lower bracket 504*b*.

In one embodiment, said lower bracket 504*a* and said lower bracket 504*b* can comprise two embodiments of said lower bracket 504. Distinguishing said lower bracket 504*a* and said lower bracket 504*b* can comprise said inside tab 506 having various lengths for various purposes.

FIGS. 12A, 12B, 12C and 12D illustrate an elevated side view of said first hydro-thruster diversion fin 124*a*, said second hydro-thruster diversion fin 124*b*, said third hydro-thruster diversion fin 124*c* and said fourth hydro-thruster diversion fin 124*d*.

In one embodiment, said lower portions 1204 can each comprise an upper portions 1202 and a lower portions lower portions 1204. In one embodiment, said upper portions 1202 fit into said upper plate slots 906 and said lower portions 1204 fit into said lower bracket slots 908.

In one embodiment, said one or more hydro-thruster diversion fins 124 can comprise a generally trapezoidal shape with a longer upper portion than lower portion, as illustrated. For example, said first hydro-thruster diversion fin 124*a* can comprise an upper width 1206*a* being longer than a lower width 1208*a*.

FIGS. 13A and 13B illustrate an elevated top view of said horizontal bracket 904 and an elevated side view of said vertical brackets 902.

In one embodiment, said horizontal bracket 904 can comprise said plurality of apertures 910 (which can comprise a first aperture 1302*a*, a second aperture 1302*b*, a third aperture 1302*c*, and a fourth aperture 1302*d*) and a slots 1304 (which can comprise a first slot 1304*a* and a second slot 1304*b*).

In one embodiment, said vertical brackets 902 can each comprise a lower tab 1302 which can attach into said slots 1304 and be bound thereto with a weld, as is known in the art.

In one embodiment, each of said vertical brackets 902 can comprise a plurality of apertures 1308 (which can comprise a first aperture 1308*a*, a second aperture 1308*b*, a third aperture 1308*c*, a fourth aperture 1308*d*, and a fifth aperture 1308*e*). In one embodiment, a portion of said one or more actuators 152 can attach to said first mounting bracket 128*a*, as illustrated and discussed in the context of said one or more surf tabs 100.

FIG. 14 illustrates a diagram view of a flow chart 1400.

In one embodiment, said flow chart 1400 can comprise a first step 1402*a*, a second step 1402*b*, a third step 1402*c*, a fourth step 1402*d*, a fifth step 1402*e*, a sixth step 1402*f*, a seventh step 1402*g*, an eighth step 1402*h*, a ninth step 1402*k*, a tenth step 1402*m*, an eleventh step 1402*n*, and a twelfth step 1402*p*. The method of utilizing the one or more surf tabs 100 may be achieved by performing the steps of said flow chart 1400.

Said first step 1402*a* can comprise procuring an one or more surf tabs 100; said second step 1402*b* can comprise mounting the mounting hinge 108 to the transom 402 of a watercraft 101; said third step 1402*c* can comprise installing the one or more actuators 152 and associated control equipment into the watercraft 101; said fourth step 1402*d* can comprise adjusting the control rod assembly 126 to position the hydro-thruster assembly 116 at a desired angle; said fifth step 1402*e* can comprise preparing the watercraft 101 for transport to a suitable body of water by lifting the one or more surf tabs 100 to its maximum upper stowing position; said sixth step 1402*f* can comprise transporting and launching the watercraft 101 at the body of water in a normal manner; said seventh step 1402*g* can comprise motioning the watercraft 101 across the water 150; said eighth step 1402*h* can comprise lowering the main control plate 104 below the water 150 using the one or more actuators 152; said ninth step 1402*k* can comprise adjusting the angle of the main control plate 104 until obtaining a wake having desired characteristics; said tenth step 1402*m* can comprise utilizing the one or more surf tabs 100 to perform surfing and similar water sports activities as desired; said eleventh step 1402*n* can comprise returning the one or more surf tabs 100 to its uppermost stowing position when not in use; and, said twelfth step 1402*p* can comprise benefiting from an easily configured wake form, afforded an user of said one or more surf tabs 100. In one embodiment, said port surf tab 100*b* can be added and used in a similar manner.

It is noted that for implementing said surf tab 500, as opposed to said one or more surf tabs 100, said third step 1402*c* and said fourth step 1402*d* may be omitted when working through said flow chart 1400.

FIG. 15 illustrates an elevated top view of said surf tab 500 with backlines exposed and said fluid 604 superimposed thereupon.

Here, it is illustrated that said fluid-in 604*a* enters into said surf tab 500 at said leading end 704, passes through said hydro-thruster assembly 116 and exits as said fluid-out 604*b*. In one embodiment, said fluid-out 604*b* exits toward said exterior edge 702*a* and rearward.

FIGS. 16A and 16B illustrate an elevated top view of a portion of said watercraft 101 with a one or more surf tabs 1600.

In one embodiment, said one or more surf tabs 1600 can comprise a port surf tab 500*a* and a port surf tab 500*b*. Or, it can be said that said one or more surf tabs 1600 can comprise at least a first surf tab attached to a watercraft 101. In this description, said first surf tab can comprise said starboard surf tab 500*a* and/or said port surf tab 500*b*. Further, it can be said that said one or more surf tabs 1600 can additionally comprise a second surf tab; wherein, said second surf tab can comprise the other among said starboard surf tab 500*a* and/or said port surf tab 500*b*.

In one embodiment, said surf tab 500 can be mounted to said watercraft 101 as illustrated as said port surf tab 500*b* and said port surf tab 500*a*. Said port surf tab 500*b* can be a mirror image version of said port surf tab 500*a*. All of the discussion of said surf tab 500 herein can be allied to said port surf tab 500*a* and said port surf tab 500*b*, as would be obvious to one in the art.

Similar to said one or more surf tabs 100: said surf tab 500 can be mounted to said transom 402 of said watercraft 101; said surf tab 500 can be pivotable on said mounting hinge 108; said one or more mounting brackets 128 can selectively attach to said one or more actuators 152; and said one or more actuators 152 can be adjusted so as to engage said surf tab 500 between a deployed position 1604*a* and a non-deployed position 1604*b*.

As discussed above, since said surf tab 500 and/or said one or more surf tabs 100 are attached to said transom 402 of said watercraft 101, said watercraft 101 pulls said surf tab 500 through said water 150. A deeper discussion of the fluid dynamics of said surf tab 500 follows.

Said surf tab 500 can be partially submerged under said water 150 while in said deployed position 1604*a*, and partially above said water 150 while in said non-deployed position 1604*b*. For example, FIG. 16B illustrates said port surf tab 500*a* in said non-deployed position 1604*b* and said port surf tab 500*b* in said deployed position 1604*a*. Accordingly, said deployed position 1604*a* can employ said hydro-thruster assembly 116 under said water 150; and said non-deployed position 1604*b* can substantially remove said hydro-thruster assembly 116 from under said water 150.

In one embodiment, said watercraft 101 can comprise a centerline 1610. In one embodiment, said starboard surf tab 500*a* and said port surf tab 500*b* can be mounted to said transom 402 on either side of said centerline 1610. Said exterior edge 702*a* can comprise a portion of said surf tab 500 furthest from said centerline 1610 and said interior edge 702*b* can comprise a portion closest thereto.

FIG. 17 illustrates a first fluid dynamics analysis 1700 of said surf tab 500 on said watercraft 101.

Said first fluid dynamics analysis 1700 can comprise a description of the effect of said port surf tab 500*b* in said deployed position 1604*a* and said port surf tab 500*a* in said non-deployed position 1604*b*, as illustrated.

In one embodiment, said hydro-thruster assembly 116 of said surf tab 500 can create a plurality of fluid channels 1702. Said plurality of fluid channels 1702 can comprise a first channel 1702*a*, a second channel 1702*b*, a third channel 1702*c*, and a fourth channel 1702*d*.

Said propeller 404 can create a propeller wash 1704. Said propeller wash 1704 can disrupt fluid behind said watercraft 101. Said watercraft 101 can pass through said water 150 with a port side flow 1706*a* and a port side flow 1706*b*. In one embodiment, said port side flow 1706*b* and said port side flow 1706*b* can comprise a smooth surface relative to waters behind said watercraft 101.

Said one or more hydro-thruster diversion fins 124 are arranged to deflect said fluid-out 604*b* at various angles and pressures. For example, in one embodiment, said angles 1004*a*-1004*d* can comprise 17 degrees relative to said centerline 1610; wherein, said first channel 1702*a* and said second channel 1702*b* can each comprise a 6 square inch channel, said third channel 1702*c* can comprise a 5 square inch channel, and said fourth channel 1702*d* can comprise a 3 square inch channel. Said leading end 704 can be deployed at 12 degrees relative to said centerline 1610. Accordingly, in one embodiment, said surf tab 500 can be configured to cause said plurality of fluid channels 1702 to arrive at an equal pressure area 1720 with various pressures; for example, said first channel 1702*a* can arrive at 480 pounds of lifting force, said second channel 1702*b* can arrive with 470 pounds, said third channel 1702*c* can arrive with 320 pounds and said fourth channel 1702*d* can arrive with 180 pounds of lifting force, as is known in the art. In one embodiment, said first channel 1702*a* can do most of the work on account of being larger so as to shape the pocket/wave behind said watercraft 101. The rest of said plurality of fluid channels 1702 can create a push in the pocket to drive a surfer forward, as is known in the art.

In one embodiment, said surf tab 500 can be useful for: shaping a wave behind said watercraft by driving said watercraft through a portion of said water, pulling said first surf tab through a portion of said water, diverting a portion of said fluid-out with said one or more hydro-thruster diversion fins into a plurality of fluid channels being directed outward relative to said centerline of said watercraft, creating a low pressure area proximate to said centerline interior to said first surf tab which combines with a high pressure area along side of said watercraft, missing said low pressure area and said high pressure areas to as to create a wave behind said watercraft. Likewise, said wave can be further shaped by dividing up said fluid-out into said plurality of fluid channels with said one or more hydro-thruster diversion fins, and decreasing the size of said plurality of fluid channels with the larger channels being proximate to said to said centerline and the smaller channels being further from said centerline.

FIG. 18 illustrates a second fluid dynamics analysis 1800.

In one embodiment, said plurality of fluid channels 1702 can be used to form a wave behind said watercraft 101. Said plurality of fluid channels 1702 can result from said hydro-thruster assembly 116 being employed below said water 150 as said watercraft 101 moves in said direction of travel 1602. Said plurality of fluid channels 1702 can direct portions of said water 150 outward relative to a centerline of said watercraft 101. Thus, said port surf tab 500*a* can direct water to the port and said port surf tab 500*b* can direct water toward the starboard of side thereof.

In one embodiment, said starboard side flow 1706*b* and said starboard side flow 1706*b* can be relatively high pressure areas; for example, said starboard side flow 1706*b* can be a high pressure area 1802. Whereas, water between said starboard surf tab 500*a* and said port surf tab 500*b* can be relatively low pressure areas. Since said hydro-thruster assembly 116 directs a portion of said water 150 outward a low pressure area 1804 can be form behind and interior to said surf tab 500, as illustrated. Meanwhile, at some distance behind said watercraft 101 an equal pressure area 1720 can be formed; wherein, a water level can be higher on a first side 1808 and lower on a second side 1810 of said equal pressure area 1720. In one embodiment, said 1720/can comprise a location where the relatively high pressure of said starboard side flow 1706*b* overtakes the relatively low pressure of said plurality of fluid channels 1702.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab;

said hydro-thruster assembly comprises a wedge shape;

said hydro-thruster assembly comprises a first height at said interior edge, and a second height at said exterior edge; and said first height is smaller than said second height.

2. The wake-shaping system of claim 1, wherein, said mounting hinge is operable to rotatably adjust an angle of said one or more surf tabs relative to said watercraft between a deployed position and a non-deployed position;

with said first surf tab in said deployed position, a portion of said hydro-thruster assembly is submerged in said water;

with said first surf tab in said non-deployed position, a portion of said hydro-thruster assembly is not submerged in said water; and with a portion of said hydro-thruster assembly submerged in said water said first surf tab is configured to divert a portion of said water outward and rearward of said watercraft.

3. The wake-shaping system of claim 2, wherein, said mounting hinge comprises a piano-type hinge.

4. The wake-shaping system of claim 1, wherein,
each of said one or more surf tabs further comprise a one or more actuators;
said one or more actuators comprise at least a first actuator;
said first mounting bracket is attached to said top side of said first surf tab;
said first actuator comprises a first end and a second end;
said first end of said first actuator attaches to said first surf tab at said first mounting bracket; and
said second end of said first actuator attaches to a portion of said watercraft.

5. The wake-shaping system of claim 4, wherein,
said mounting hinge is operable to rotatably adjust an angle of said one or more surf tabs relative to said watercraft;
said one or more actuators are operable to move said one or more surf tabs between a deployed position and a non-deployed position;
said first surf tab is configured to rotate on said mounting hinge between said deployed position and said non-deployed position;
with said first surf tab in said deployed position, a portion of said hydro-thruster assembly is submerged in said water;
with said first surf tab in said non-deployed position, a portion of said hydro-thruster assembly is not submerged in said water; and
with a portion of said hydro-thruster assembly submerged in said water said first surf tab is configured to divert a portion of said water outward and rearward of said watercraft.

6. The wake-shaping system of claim 4, wherein,
said one or more actuators are electric linear actuators; and
said one or more actuators are operable to be electrically controlled to raise and lower said one or more surf tabs on said mounting hinge.

7. The wake-shaping system of claim 1, wherein,
portions of said one or more surf tabs comprise welded aluminum.

8. The wake-shaping system of claim 1, wherein,
said one or more surf tabs comprise said first surf tab and a second surf tab;
said first surf tab is mounted either on said starboard side and/or said port side of said watercraft;
said second surf tab is mounted on the opposite side of said centerline relative to said first surf tab;
said second surf tab is configured to be a mirror image of said first surf tab relative to said centerline; and
said first surf tab and said second surf tab each comprise
said hydro-thruster assembly configured to direct said fluid-out toward said exterior edge,
said upper plate,
said mounting hinge,
said lower portion, and
said one or more mounting brackets comprising at least said first mounting bracket.

9. The wake-shaping system of claim 1, wherein,
shaping a wave behind said watercraft by
driving said watercraft through a portion of said water,
pulling said first surf tab through a portion of said water,
diverting a portion of said fluid-out with said one or more hydro-thruster diversion fins into a plurality of fluid channels being directed outward relative to said centerline of said watercraft,
creating a first pressure area proximate to said centerline interior to said first surf tab which combines with a second pressure area along side of said watercraft,
missing said first pressure area and said second pressure area to as to create a wave behind said watercraft; further wherein,
said first pressure area is a lower pressure than said second pressure area.

10. A method of using a wake-shaping system comprising:
procuring a one or more surf tabs comprising at least a first surf tab,
mounting a mounting hinge of said first surf tab to a transom of a watercraft,
transporting and launching said watercraft on a surface of a water,
motioning said watercraft in a direction of travel across said water,
receiving a portion of said water into a leading edge of said first surf tab as a fluid-in,
channeling a portion of said water through a portion of said first surf tab, and
ejecting a portion of said water out of a hydro-thruster assembly of said first surf tab in a direction being rearward and outward of a centerline of said watercraft; wherein,
said first surf tab comprises
an upper plate,
said mounting hinge,
a lower portion,
a one or more mounting brackets comprising at least a first mounting bracket,
said hydro-thruster assembly having a one or more hydro-thruster diversion fins,
said leading edge,
a trailing edge,
an interior side,
an exterior side,
a top side and
a bottom side;
said upper plate is rotatably attached to a portion of said watercraft with said mounting hinge;
said watercraft travels through said water in said direction of travel;
said leading edge comprises a forward portion of first surf tab relative to said direction of travel;
said trailing edge comprises a rearward portion of first surf tab relative to said direction of travel;
said watercraft comprises said centerline dividing a starboard side from a port side of said watercraft;
said first surf tab is mounted either on said starboard side and/or said port side of said watercraft;
said interior edge comprises a portion of said one or more surf tabs closest to said centerline of said watercraft;
said exterior edge comprises a portion of said one or more surf tabs furthest to said centerline of said watercraft;
each of said one or more hydro-thruster diversion fins comprise an upper portions and a lower portions;
said hydro-thruster assembly comprises said one or more hydro-thruster diversion fins situated between a portion of said upper plate and a lower bracket;
said hydro-thruster assembly is attached at said trailing edge of said first surf tab;
shaping a wave behind said watercraft by
driving said watercraft through a portion of said water, pulling said first surf tab through a portion of said water, diverting a portion of said fluid-out with said one or more hydro-thruster diversion fins into a plurality of fluid channels being directed outward relative to said centerline of said watercraft, creating a first pressure area proximate to said centerline interior to said first surf tab which combines with a second pressure area along side of said watercraft, missing said first pressure area and said second pressure area to as to create a wave behind said watercraft;

said first pressure area is a lower pressure than said second pressure area; and said wave is further shaped by dividing up said fluid-out into said plurality of fluid channels with said one or more hydro-thruster diversion fins, and decreasing the size of said plurality of fluid channels with the larger channels being proximate to said centerline and the smaller channels being further from said centerline.

11. The method of claim 10, wherein, rotatably adjusting an angle of said first surf tab relative to said watercraft with said mounting hinge between a deployed position and a non-deployed position; wherein, with said first surf tab in said deployed position, a portion of said hydro-thruster assembly is submerged in said water;

with said first surf tab in said non-deployed position, a portion of said hydro-thruster assembly is not submerged in said water; and with a portion of said hydro-thruster assembly submerged in said water said first surf tab is configured to divert a portion of said water outward and rearward of said watercraft.

12. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab; and said one or more hydro-thruster diversion fins comprises a first hydro-thruster diversion fin, a second hydro-thruster diversion fin, a third hydro-thruster diversion fin, and fourth hydro-thruster diversion fin.

13. The wake-shaping system of claim 12, wherein, said one or more hydro-thruster diversion fins each comprise a leading edge and a trailing edge;

said trailing edges of said one or more hydro-thruster diversion fins are arranged closer to said exterior edge of said first surf tab than said leading edges of said one or more hydro-thruster diversion fins; and thus, said one or more hydro-thruster diversion fins are arranged to thrust said fluid-out in an outward direction rearward of said exterior edge of said first surf tab.

14. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab;

said upper plate comprises an inside tab and an outside tab;

said inside tab and said outside tab are within a front half of said upper plate proximate to said leading edge;

said upper plate comprises a substantially planar sheet of metal being cut to include said inside tab and said outside tab;

said inside tab and said outside tab of said upper plate are bent down to be at a right angle with respect to the rest of said upper plate;

said inside tab comprises a portion of said interior edge of said first surf tab; and said outside tab comprises a portion of said outside edge of said first surf tab.

15. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab;

said upper plate comprises an upper plate slots;

said lower bracket comprises a lower bracket slots;

said one or more hydro-thruster diversion fins each comprise an upper portions and a lower portions;

a portion of said upper portions are configured to slide into said upper plate slots;

a portion of said lower portions are configured to slide into said lower bracket slots; and said one or more hydro-thruster diversion fins are arranged between said upper plate and said lower bracket.

16. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab;

said lower bracket is attached at said trailing edge of said first surf tab and below said upper plate;

said lower bracket comprises a planar sheet of metal having an inside tab at said interior edge of said first surf tab;

said inside tab is bent up at a right angle relative to the rest of said lower bracket; and said inside tab contains a portion of said fluid-out of said first surf tab so as to channel it outward rather than inward at said interior edge.

17. A wake-shaping system, comprising:

a one or more surf tabs attached to a watercraft;

said one or more surf tabs comprise at least a first surf tab;

said first surf tab comprises an upper plate, a mounting hinge, a lower portion, a one or more mounting brackets comprising at least a first mounting bracket, and a hydro-thruster assembly having a one or more hydro-thruster diversion fins;

further, said first surf tab comprises a leading edge, a trailing edge, an interior side, an exterior side, a top side and a bottom side;

said upper plate is rotatably attached to a portion of said watercraft with said mounting hinge;

said watercraft travels through a water in a direction of travel;

said leading edge comprises a forward portion of first surf tab relative to said direction of travel;

said trailing edge comprises a rearward portion of first surf tab relative to said direction of travel;

said watercraft comprises a centerline dividing a starboard side from a port side of said watercraft;

said first surf tab is mounted either on said starboard side and/or said port side of said watercraft;

said first surf tab is configured for receiving a portion of said water as a fluid-in, channeling a portion of said water through a portion of said first surf tab, and ejecting a portion of said water out of said hydro-thruster assembly in a direction being rearward and outward of said centerline of said watercraft;

said interior edge comprises a portion of said one or more surf tabs closest to said centerline of said watercraft;

said exterior edge comprises a portion of said one or more surf tabs furthest to said centerline of said watercraft;

each of said one or more hydro-thruster diversion fins comprise an upper portions and a lower portions;

said hydro-thruster assembly comprises said one or more hydro-thruster diversion fins situated between a portion of said upper plate and a lower bracket;

said hydro-thruster assembly is attached at said trailing edge of said first surf tab; and said wave is further shaped by dividing up said fluid-out into said plurality of fluid channels with said one or more hydro-thruster diversion fins, and decreasing the size of said plurality of fluid channels with the larger channels being proximate to said centerline and the smaller channels being further from said centerline.

* * * * *